US007367783B2

(12) United States Patent
Matsumoto et al.

(10) Patent No.: US 7,367,783 B2
(45) Date of Patent: May 6, 2008

(54) ROTATING FLUID MACHINE

(75) Inventors: Kenji Matsumoto, Wako (JP); Naoki Itoh, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 701 days.

(21) Appl. No.: 10/791,739

(22) Filed: Mar. 4, 2004

(65) Prior Publication Data

US 2004/0228740 A1 Nov. 18, 2004

(30) Foreign Application Priority Data

Mar. 7, 2003 (JP) ..... 2003-061599
Dec. 1, 2003 (JP) ..... 2003-401320
Dec. 1, 2003 (JP) ..... 2003-401322
Dec. 1, 2003 (JP) ..... 2003-401323

(51) Int. Cl.
*F04B 1/26* (2006.01)

(52) U.S. Cl. ..... 417/222.1; 417/270; 91/499

(58) Field of Classification Search ..... 417/269, 417/270, 222.1; 91/499; 92/71; 277/396, 277/402, 404
See application file for complete search history.

(56) References Cited

U.S. PATENT DOCUMENTS 2,378,095 A * 6/1945 Payne ..... 277/396
3,312,476 A * 4/1967 Otto et al. ..... 277/397
3,585,901 A * 6/1971 Moon et al. ..... 91/499
3,823,557 A * 7/1974 Van Wagenen ..... 91/499
4,426,914 A * 1/1984 Kline ..... 91/499
5,562,425 A * 10/1996 Kimura et al. ..... 417/269
6,012,905 A * 1/2000 Takashima et al. ..... 417/269

FOREIGN PATENT DOCUMENTS

JP 61-155610 U 9/1986

* cited by examiner

*Primary Examiner*—Devon C. Kramer
*Assistant Examiner*—Peter J Bertheaud
(74) *Attorney, Agent, or Firm*—Birch, Stewart, Kolasch & Birch, LLP

(57) ABSTRACT

A rotary valve for switching supply passages, and discharge passages of high-temperature and high-pressure steam for a rotor rotatably supported at a casing is constructed by making a fixed side valve plate and a movable side valve plate abut to each other on a slide surface. A pressure chamber into which the high-temperature and high-pressure steam is introduced from the supply passage is opened to a mating surface of a valve body portion with the fixed side valve plate. The fixed side valve plate supported to float is pressed against the movable side valve plate with a pressing load generating in the pressure chamber to bring it into close contact with the slide surface. Leakage of the high-temperature and high-pressure steam from the pressure chamber is prevented by placing a V-packing inside the pressure chamber.

22 Claims, 28 Drawing Sheets

ROTATING FLUID MACHINE

This Nonprovisional application claims priority under 35 U.S.C. §119(a) on patent application No(s). 2003-061599; 2003-401320; 2003-401322 and 2003-401323 filed in JAPAN on Mar. 7, 2003; Dec. 1, 2003; Dec. 1, 2003 and Dec. 1, 2003, the entire contents of which are hereby incorporated by reference.

BACKGROUND OF THE INVENTION

1. Field of the Invention

The present invention relates to a rotating fluid machine including a casing, a rotor rotatably supported at the casing, a working part provided at the rotor, and a rotary valve provided between the casing and the rotor to control supply and discharge of a working medium to and from the working part.

2. Description of the Related Art

Japanese Utility Model Laid-Open No. 61-155610 discloses a rotating fluid machine for supplying a combustion gas generating in a combustor to an axial piston cylinder group via a distributing mechanism (rotary valve), in which a pressing member is pressed with a spring to bring the pressing member into close contact with a slide surface when the combustion gas is not supplied, and the pressing member is pressed via a free piston with pressure of the combustion gas to bring it into close contact with the slide surface when the combustion gas is supplied, thereby securing the sealing performance of the slide surface of the distributing mechanism (valve seat).

A small swing occurs to the rotor, which is supported at the casing with ball bearings, during rotation, and therefore it is inevitable that swing also occurs to the slide surface of the rotary valve. At this time, it is difficult to secure sealing performance with the pressing member following the swing of the slide surface by only biasing the pressing member with a resilient force of the spring, pressure of the combustion gas, pressure of a supply gas at high temperature and high pressure or pressure of steam to bring the pressing member into close contact with the slide surface.

In a rotary valve for an expansion machine, it is considered to form a pressure chamber open to a mating surface with the fixed side valve plate in a valve body portion and make the pressure of the working medium act on a back surface of a seal member having flexibility, such as a V-packing, housed in the pressure chamber, to thereby press the fixed side valve plate against a movable side valve plate to secure the sealing performance of the slide surface.

However, when the pressure of the working medium does not rise sufficiently just after the start of the expansion machine, the seal member cannot exhibit the sufficient sealing function due to insufficient pressure, and if a foreign matter such as an oxidized scale is contained in the working medium, the seal member is damaged, and the sealing performance is further reduced, which brings about the possibility that the expansion machine cannot exhibit sufficient performance.

The movable side valve plate provided at the rotor inevitably oscillates a little. If the fixed side valve plate in contact with the movable side valve plate via the slide surface oscillates, there is the possibility that the close contact of a seat surface of the fixed side valve plate and a lip of the seal member is impaired and steam leaks out of this portion to make it impossible for the expansion machine to exhibit sufficient performance.

When the pressure of the working medium supplied to the pressure chamber is low, the outer periphery surface of the V-packing cannot be firmly pressed against an inner periphery surface of the pressure chamber, and the working medium sometimes leaks out of the pressure chamber due to reduction in the sealing function. Once this leakage occurs, the leakage cannot be stopped even if the pressure of the working medium increases, and therefore it is necessary to stop the operation of the expansion machine and restart it thereafter. In order to solve these problems, it can be considered to enhance sealing performance by pressing the V-packing in the axial direction with coil spring. However, since it is difficult to bias the V-packing outward in the radial direction with the coil spring placed in the axial direction and the resilient force of the coil spring reduces when the working medium is at high temperature, a sufficient effect cannot be expected.

SUMMARY OF THE INVENTION

The present invention has been achieved in view of the above-mentioned circumstances, and has an object to secure sealing performance of a slide surface of a rotary valve of a rotating fluid machine.

In order to achieve the above-described object, according to a first feature of the present invention, there is provided a rotating fluid machine comprising: a casing; a rotor rotatably supported at the casing; a working part provided at the rotor; and a rotary valve provided between the casing and the rotor and switching a supply passage and a discharge passage of a working medium for the working part, in which the rotary valve is constructed by making a movable side valve plate provided at the rotor, and a fixed side valve plate supported to float at a valve body portion non-rotatably fixed to the casing, abut to each other on a slide surface orthogonal to an axis, wherein a pressure chamber into which the working medium is introduced from a passage at a high pressure side out of the supply passage and the discharge passage of the working medium is opened to a mating surface of the valve body portion with the fixed side valve plate, leakage of the working medium from the pressure chamber to the mating surface is sealed by a seal member housed in the pressure chamber, and the fixed side valve plate is pressed toward the slide surface with pressure of the working medium acting on the pressure chamber.

With the first feature, the fixed side valve plate is non-rotatably supported to float at the valve body portion fixed to the casing, the high-pressure working medium is supplied to the pressure chamber formed in the valve body portion to open to the mating surface with the fixed side valve plate, and the mating surface is sealed by the seal member to receive the pressure of the high-pressure working medium. Consequently, the pressing load to press the fixed side valve plate to the slide surface with the movable side valve plate is generated with the pressure of the working medium of the pressure chamber to bring the slide surface into close contact therewith, to prevent leakage of the working medium. The fixed side valve plate is made to follow oscillation of the slide surface by the floating support to enhance following performance of the pressing load to the slide surface, and thereby sealing performance of the slide surface can be secured.

Especially when the leakage from the slide surface easily occurs due to high pressure of the working medium, the pressing load generated by the pressure chamber becomes large correspondingly, and therefore the friction resistance of the slide surface can be restrained to the minimum by preventing excessive increase in the aforesaid contact pressure while preventing the leakage of the working medium by always generating the optimal contact pressure on the slide surface even if the pressure of the working medium varies.

Since leakage of the working medium is prevented by sealing a space between the fixed side valve plate supported at the valve body to float and the pressure chamber with the seal member, the pressing load generated by the pressure chamber can be stabilized, and the fixed side valve plate is capable of moving in the direction of the axis and the radial direction, and therefore it oscillates with the sealing ability being secured and capable of following the inclination of the slide surface.

In addition to the first feature, according to a second feature of the present invention, the seal member has a seal lip elastically deformable by softening due to pressure and heat of the working medium.

With the second feature, the seal member has the seal lip which is elastically deformed by softening due to the pressure and heat of the working medium, and therefore the seal lip is deformed in accordance with increase in the pressure and rise in the temperature of the working medium to make it possible to further enhance the sealing performance and to move in the axial direction at low friction owing to the shape of the seal lip.

In addition to the first or second feature, according to a third feature of the present invention, the rotating fluid machine further comprises resiliently biasing means for biasing the seal member toward the mating surface.

With the third feature, the seal member is biased toward the mating surface with the fixed side valve plate with the resiliently biasing means, and therefore when the pressure of the working medium does not rise, the seal member is biased to make it possible to secure the sealing performance. In addition, the vibration of the fixed side valve plate following the swing of the slide surface can be damped with the resilient force of the resiliently biasing means in combination with the damping property of the seal member, thus making it possible to secure close contactability of the slide surface.

In addition to the third feature, according to a fourth feature of the present invention, the resiliently biasing means is a taper coil spring tapering toward the seal member.

With the fourth feature, the resiliently biasing means is constructed by the taper coil spring tapering toward the seal member, and therefore the fixed side valve plate can be made to oscillate around the axis to follow the oscillation different from the swing of the fixed side valve plate following the swing of the slide surface generated by the movable side valve plate, to make it possible to secure close contactability of the slide surface more effectively in combination with the damping property by the resiliently biasing means.

In addition to any one of the first to fourth features, according to a fifth feature of the present invention, a passage at a low temperature side out of the supply passage and the discharge passage of the working medium is provided in a center of the valve body portion, and an annular pressure chamber is formed to surround a periphery of the passage at the low temperature side.

With the fifth feature, the annular pressure chamber is formed to surround the periphery of the passage of the working medium at the low temperature side provided in the center of the valve body portion, and therefore the sealing performance can be kept with the temperature rise of the seal member housed in the pressure chamber being restrained. In addition, smoothness and abrasion resistance of the slide surface can be maintained by cooling the fixed side valve plate and the movable side valve plate with the working medium at the low temperature side.

In addition to any one of the first to fourth features, according to a sixth feature of the present invention, the passage at the high pressure side out of the supply passage and the discharge passage of the working medium is provided in a center of the valve body portion, and an annular pressure chamber is formed to surround a periphery of the passage at the high pressure side.

With the sixth feature, the annular pressure chamber is formed to surround the periphery of the passage of the working medium at the high pressure side provided in the center of the valve body portion, and therefore the pressing load generated in the pressure chamber can be made to act on the slide surface uniformly. Consequently, even if the pressure chamber is made compact and the pressing load is set to be small, close contactability of the slide surface is secured to make it possible to prevent uneven abrasion, and the pressing load to the slide surface can be optimally minimized, thus making it possible to reduce frictional resistance occurring to the slide surface and reduce the loss torque of the rotating fluid machine.

In addition to any one of the first to fourth features, according to a seventh feature of the present invention, the seal member has a first seal lip for sealing a space from the mating surface of the fixed side valve plate, and a second seal lip for sealing a space from an inner periphery surface of the pressure chamber.

With the seventh feature, the space from the mating surface of the fixed side valve plate is sealed with the first seal lip of the seal member, and the space from the inner periphery surface of the pressure chamber is sealed with the second seal lip, to make it possible to keep sealing performance of the pressure chamber. The second seal lip is in close contact with the inner periphery surface of the pressure chamber with favorable following performance with respect to the variation in the pressure of the working medium and the displacement of the fixed side valve plate in the axial direction and the radial direction due to its lip structure, and is able to enhance the sealing performance.

In addition to any one of the first to fourth features, according to an eighth feature of the present invention, the seal member has a first seal lip for sealing a space from the mating surface of the fixed side valve plate, and a second seal lip for sealing a space from an outer periphery surface of a working medium pipe inserted into the pressure chamber.

With the eighth feature, the space from the mating surface of the fixed side valve plate is sealed with the first seal lip of the seal member, and the second seal lip follows the thermal extension in the radial direction of the working medium pipe inserted into the pressure chamber due to the high-temperature working medium, and seals the space from the outer periphery surface of the working medium pipe to make it possible to keep sealing performance for the pressure chamber. Since the second seal lip especially seals the outer periphery surface of the working medium pipe with a small diameter as compared with the inner periphery surface of the pressure chamber, the seal lip is in linear contact in the radial direction, and can smoothly follow the thermal extension of the working medium pipe with the friction resistance at the seal portion being reduced, and the fixed side valve plate can follow the oscillation in the axial direction and the radial direction of the slide surface with the seal member as the center.

In addition to any one of the first to fourth features, according to a ninth feature of the present invention, contact pressure of the slide surface is set in accordance with a ratio of an area in which pressure of the pressure chamber acts on the mating surface, to an area of the slide surface.

With the ninth feature, the contact pressure of the slide surface is set in accordance with the ratio of the area in which the pressure of the pressure chamber acts on the mating surface, to the area of the slide surface, and therefore the optimal contact pressure at which the friction resistance of the slide surface can be reduced while the sealing performance of the slide surface being secured can be obtained.

According to a tenth feature of the present invention, there is provided a rotating fluid machine comprising: a casing; a rotor rotatably supported at the casing; a working part provided at the rotor; and a rotary valve provided between the casing and the rotor and controlling supply and discharge of a working medium for the working part, in which the rotary valve has a fixed side valve plate non-rotatably supported to float at a valve body portion fixed at a casing side and a movable side valve plate supported at a rotor side brought into contact with each other on a slide surface orthogonal to an axis; a pressure chamber into which the high-pressure working medium is introduced is opened to a mating surface of the valve body portion with the fixed side valve plate; leakage of the working medium from the pressure chamber to the mating surface is prevented by a seal member housed in the pressure chamber; and the fixed side valve plate and the movable side valve plate are brought into close contact with each other on the slide surface with pressure of the working medium acting on the pressure chamber, wherein a seal ring for receiving the pressure of the working medium is provided on an outer periphery surface of the seal member, and a space between an inner periphery surface of the pressure chamber and the outer periphery surface of the seal member is sealed by the seal ring.

With the tenth feature, the pressure chamber into which the high-pressure working medium is introduced is opened to the mating surface of the valve body portion of the rotary valve with the fixed side valve plate, leakage of the working medium to the mating surface from the pressure chamber is prevented by the seal member housed in this pressure chamber, and when the fixed side valve plate and the movable side valve plate are brought into close contact with each other on the slide surface with the pressure of the working medium acting on the pressure chamber, the space between the inner periphery surface of the pressure chamber and the outer periphery surface of the seal member is sealed with the seal ring provided at the outer periphery surface of the seal member. Consequently, not only the leakage of the working medium can be prevented with the sealing function of the seal ring even when the seal member cannot exhibit the sufficient sealing function because the pressure of the working medium of the pressure chamber is low, but also a damage to the seal member can be prevented by catching a foreign matter included in the working medium with the seal ring.

In addition to the tenth feature, according to an eleventh feature of the present invention, the seal ring is constructed by a material with resistance to an oxidized scale.

With the eleventh feature, the seal ring is constructed by the material with the resistance to the oxidized scale, and therefore durability of the seal ring to the oxidized scale can be secured.

In addition to the eleventh feature, according to a twelfth feature of the present invention, the material with the resistance to the oxidized scale is a composite material of metal and carbon, or ceramics.

With the twelfth feature, the material with the resistance to the oxidized scale is constituted of a composite material of metal and carbon, and therefore an oxidized scale can be caught with a soft carbon while sealing performance and abrasion resistance are secured with hard metal. Since the material with the resistance to the oxidized scale is constituted of ceramics, an oxidized scale can be caught with hard porous ceramics while sealing performance and abrasion resistance are secured.

According to a thirteenth feature of the present invention, there is provided a rotating fluid machine comprising: a casing; a rotor rotatably supported at the casing; a working part provided at the rotor; and a rotary valve provided between the casing and the rotor and controlling supply and discharge of a working medium for the working part, in which the rotary valve has a fixed side valve plate non-rotatably supported to float at a valve body portion fixed at a casing side and a movable side valve plate supported at a rotor side brought into contact with each other on a slide surface orthogonal to an axis; a pressure chamber into which the high-pressure working medium is introduced is opened to a mating surface of the valve body portion with the fixed side valve plate; leakage of the working medium from the pressure chamber to the mating surface is prevented by a seal member housed in the pressure chamber; and the fixed side valve plate and the movable side valve plate are brought into close contact with each other on the slide surface with pressure of the working medium acting on the pressure chamber, wherein a lip of the seal member and a seat surface of the fixed side valve plate to which the seal member abuts are formed into spherical surfaces each having a center on the axis.

With the thirteenth feature, the pressure chamber into which the high-pressure working medium is introduced is opened to the mating surface of the valve body portion of the rotary valve with the fixed side valve plate, leakage of the working medium to the mating surface from the pressure chamber is prevented by the seal member housed in this pressure chamber, and when the fixed side valve plate and the movable side valve plate are brought into close contact with each other on the slide surface with the pressure of the working medium acting on the pressure chamber, the lip of the seal member and the seat surface of the fixed side valve plate, to which the lip abuts, are each formed into the shape of the spherical surface, and therefore the lip of the seal member is reliably brought into close contact with the seat surface of the fixed side valve plate to make it possible to secure sealing performance at the abutting portion even if the fixed side valve plate supported to float follows the movable side valve plate rotating with the rotor and oscillates.

In addition to the thirteenth feature, according to a fourteenth feature of the present invention, the lip of the seal member is formed into a convex shape, and the seat surface of the fixed side valve plate is formed into a concave shape.

With the fourteenth feature, the lip of the seal member, which has the convex shape, is made to abut to the seat surface of the fixed side-valve plate, which has the concave shape, and therefore the following performance of the seal member to the oscillation of the fixed side valve plate supported to float is made more favorable to enhance sealing performance further.

According to a fifteenth feature of the present invention, there is provided a rotating fluid machine comprising: a casing; a rotor rotatably supported at the casing; a working part provided at the rotor; and a rotary valve provided between the casing and the rotor and controlling supply and discharge of a working medium for the working part, in which the rotary valve has a fixed side valve plate supported to float to be unable to rotate at a valve body portion fixed at a casing side and a movable side valve plate supported at a rotor side brought into contact with each other on a slide surface orthogonal to an axis; a pressure chamber into which the high-pressure working medium is introduced is opened to a mating surface of the valve body portion with the fixed side valve plate; leakage of the working medium from the pressure chamber to the mating surface is prevented by a seal member housed in the pressure chamber; and the fixed side valve plate and the movable side valve plate are brought into close contact with each other on the slide surface with pressure of the working medium acting on the pressure chamber, wherein a pressing member for pressing the seal member at least outward in a radial direction is provided at a rear surface of the seal member.

With the fifteenth feature, the pressure chamber into which high-pressure working medium is introduced is opened to the mating surface of the valve body portion of the rotary valve with the fixed side valve plate, the leakage of the working medium to the mating surface from the pressure chamber is prevented by the seal member housed in this pressure chamber, and when the fixed side valve plate and the movable side valve plate are brought into close contact with each other on the slide surface with the pressure of the working medium acting on the pressure chamber, the seal member is pressed at least outward in the radial direction with the pressing member provided at the rear surface of the seal member. Consequently, even when the seal member can hardly exhibit the sealing function because the pressure chamber is under the low pressure state, the outer periphery surface of the seal member is pressed against the inner periphery surface of the pressure chamber with the pressing force of the pressing member to secure the sealing function, and leakage of the working medium can be prevented.

In addition to the fifteenth feature, according to a sixteenth feature of the present invention, the pressing member presses the seal member with a preload.

With the sixteenth feature, the pressing member presses the seal member with the preload, and therefore the seal member is made to exhibit the sealing function with the preload to be able to prevent the leakage of the working medium reliably.

In addition to the fifteenth or sixteenth feature, according to a seventeenth feature of the present invention, the pressing member is made of metal.

With the seventeenth feature, the pressing member is made of metal, and therefore when the pressure chamber has a high temperature, the pressing member is thermally expanded and presses the seal member more firmly, thereby making it possible to further enhancing the sealing performance.

The axial piston cylinder group 56 in the embodiments corresponds to the working part of the present invention, the steam supplying pipe 85 in the embodiments corresponds to the working medium pipe of the present invention, the coil spring 86 in the embodiments corresponds to the resiliently biasing means of the present invention, the V-packing 88 in the embodiments corresponds to the seal member of the present invention, the backup ring 105 in the embodiments corresponds to the pressing member of the present invention, the first and the second steam passages P1 and P2 in the embodiments correspond to the supply passage of the present invention, the fifth to the eighth step passages P5 to P8 in the embodiments correspond to the discharge passage of the present invention, and the first and the second seal lip S1 and S2 correspond to the seal lip of the present invention.

The above-mentioned object, other objects, characteristics, and advantages of the present invention will become apparent from an explanation of a preferred embodiment, which will be described in detail below by reference to the attached drawings.

BRIEF DESCRIPTION OF THE DRAWINGS

FIG. 1 is a longitudinal cross-sectional view of an expansion machine.

FIG. 2 is a cross-sectional view taken along the line 2-2 in FIG. 1.

FIG. 3 is a view taken along the line 3-3 and seen in the arrow direction in FIG. 1.

FIG. 4 is an enlarged view of the part 4 in FIG. 1.

FIG. 5 is an enlarged view of the part 5 in FIG. 1.

FIG. 6 is an exploded perspective view of a rotor.

FIG. 7 is a cross-sectional view taken along the line 7-7 in FIG. 4.

FIG. 8 is a cross-sectional view taken along the line 8-8 in FIG. 4.

FIG. 9 is an enlarged view of the part 9 in FIG. 4.

FIG. 10 is an enlarged view of the part 10 in FIG. 5.

FIG. 11 is a view taken along the line 11-11 and seen in the arrow direction in FIG. 10.

FIG. 12 is a view taken along the line 12-12 and seen in the arrow direction in FIG. 10.

FIG. 13 is a cross-sectional view taken along the line 13-13 in FIG. 5.

FIG. 14 is a cross-sectional view taken along the line 14-14 in FIG. 5.

FIG. 15 is a perspective view of a coil spring, a packing retainer and a V-packing.

FIG. 16 is an enlarged cross-sectional view of a rotary valve and its periphery.

FIG. 17 is a view taken along the line 17-17 and seen in the arrow direction in FIG. 16.

FIG. 18 is a view taken along the line 18-18 and seen in the arrow direction in FIG. 16.

FIG. 19 is a perspective view of a coil spring, a packing retainer and a V-packing.

FIG. 20 is an enlarged cross-sectional view of a rotary valve and its periphery.

FIG. 21 is a perspective view of a coil spring, a packing retainer and a V-packing.

FIG. 23 is an enlarged cross-sectional view of a rotary valve.

FIG. 24 is a view taken along the line 24-24 and seen in the arrow direction in FIG. 23.

FIG. 25 is a view taken along the line 25-25 and seen in the arrow direction in FIG. 23.

FIG. 26 is a view taken along the line 26-26 and seen in the arrow direction in FIG. 23.

FIG. 27 is a view taken along the line 27-27 and seen in the arrow direction in FIG. 23.

FIG. 28 is a perspective view of a coil spring, a packing retainer, a V-packing and a seal ring.

FIG. 29 is an enlarged cross-sectional view of a rotary valve.

FIG. 30 is a view taken along the line 30-30 and seen in the arrow direction in FIG. 29.

FIG. 31 is a perspective view of a coil spring, a packing retainer and a V-packing.

FIG. 32 is an enlarged cross-sectional view of a rotary valve.

FIG. 33 is a perspective view of a coil spring, a packing retainer, a backup ring and a V-packing.

DESCRIPTION OF THE PREFERRED EMBODIMENTS

Figure 1:
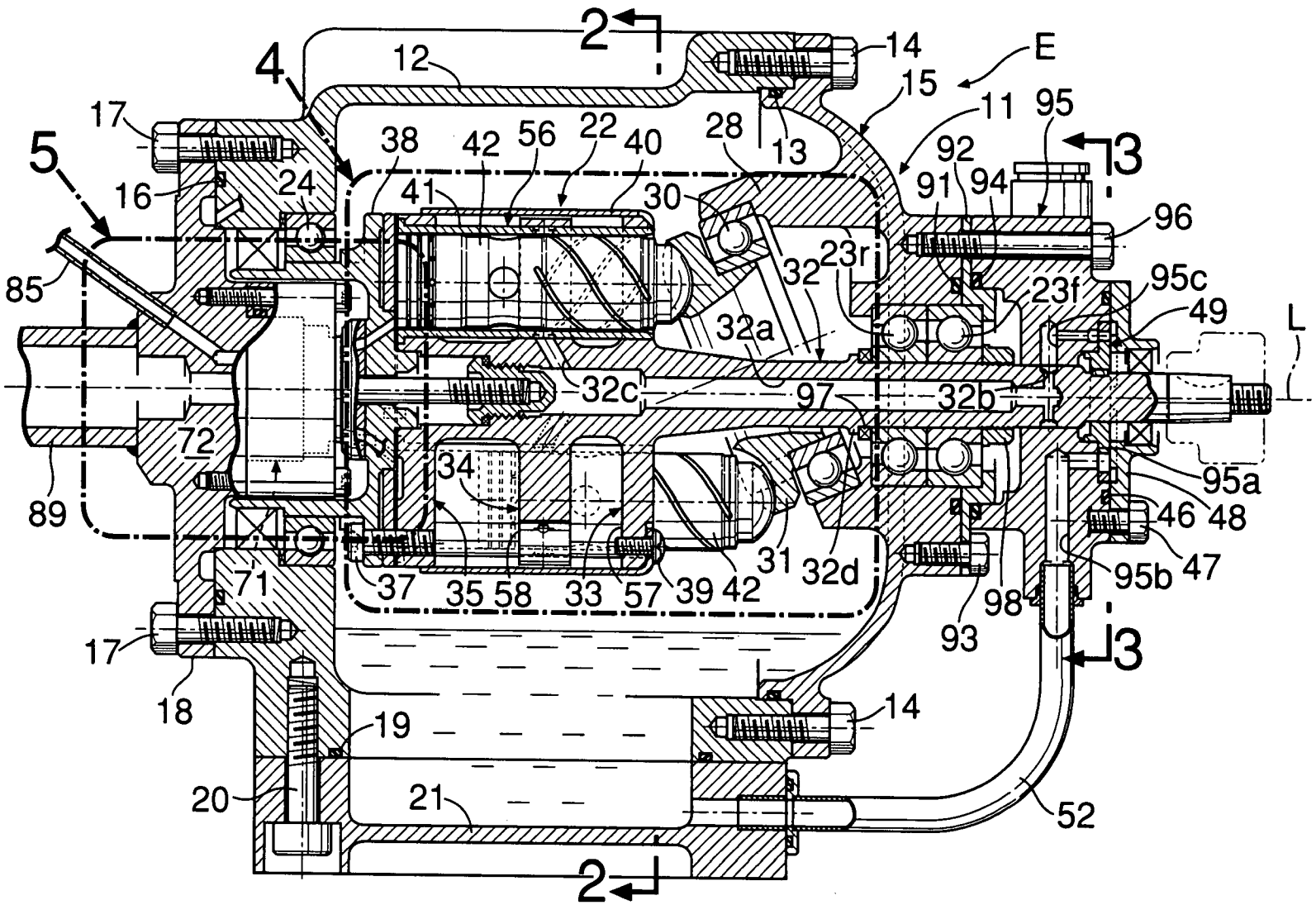
FIG. 1 to FIG. 15 show a first embodiment of the present invention.
Figure 2:
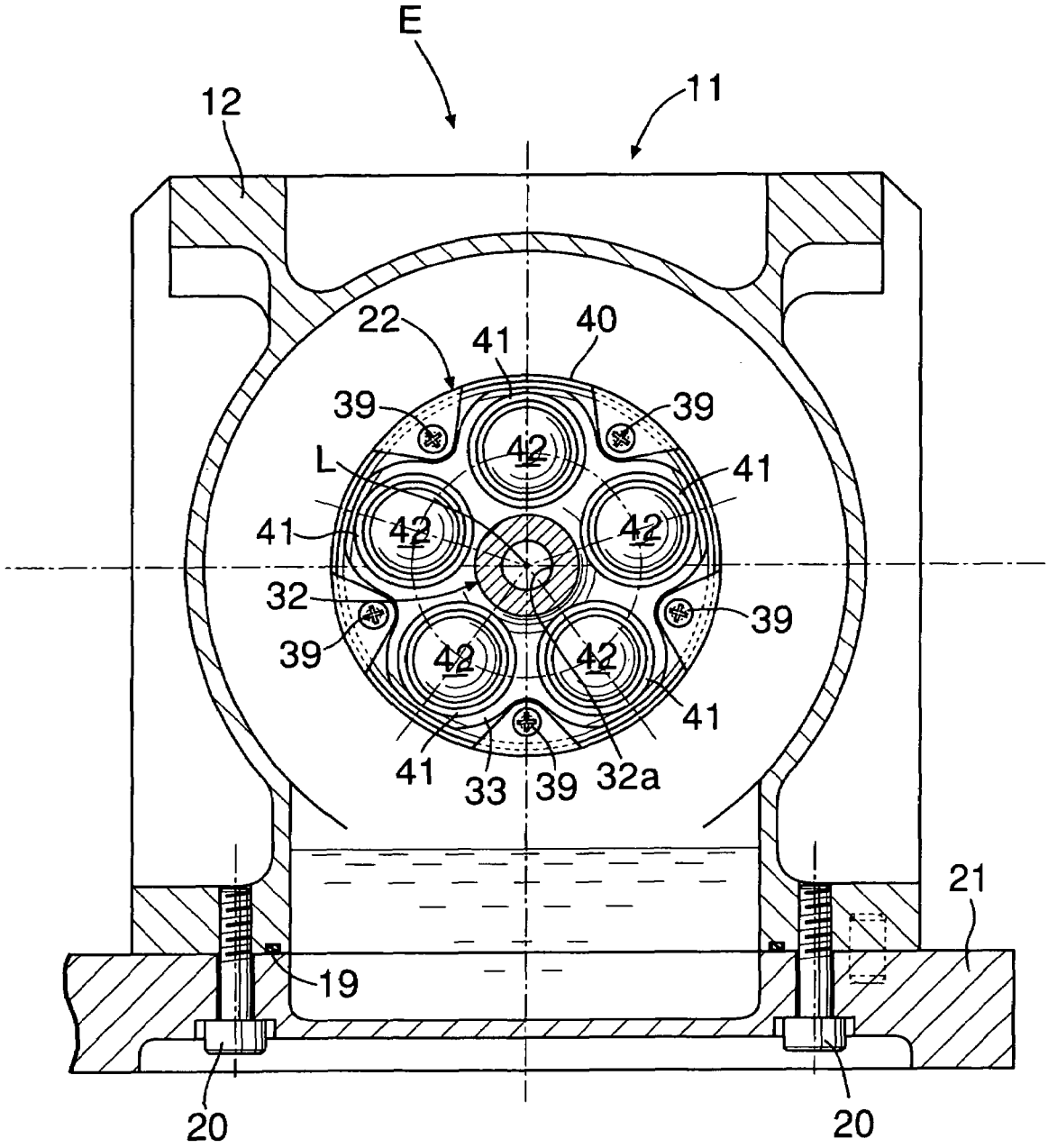
Figure 3:
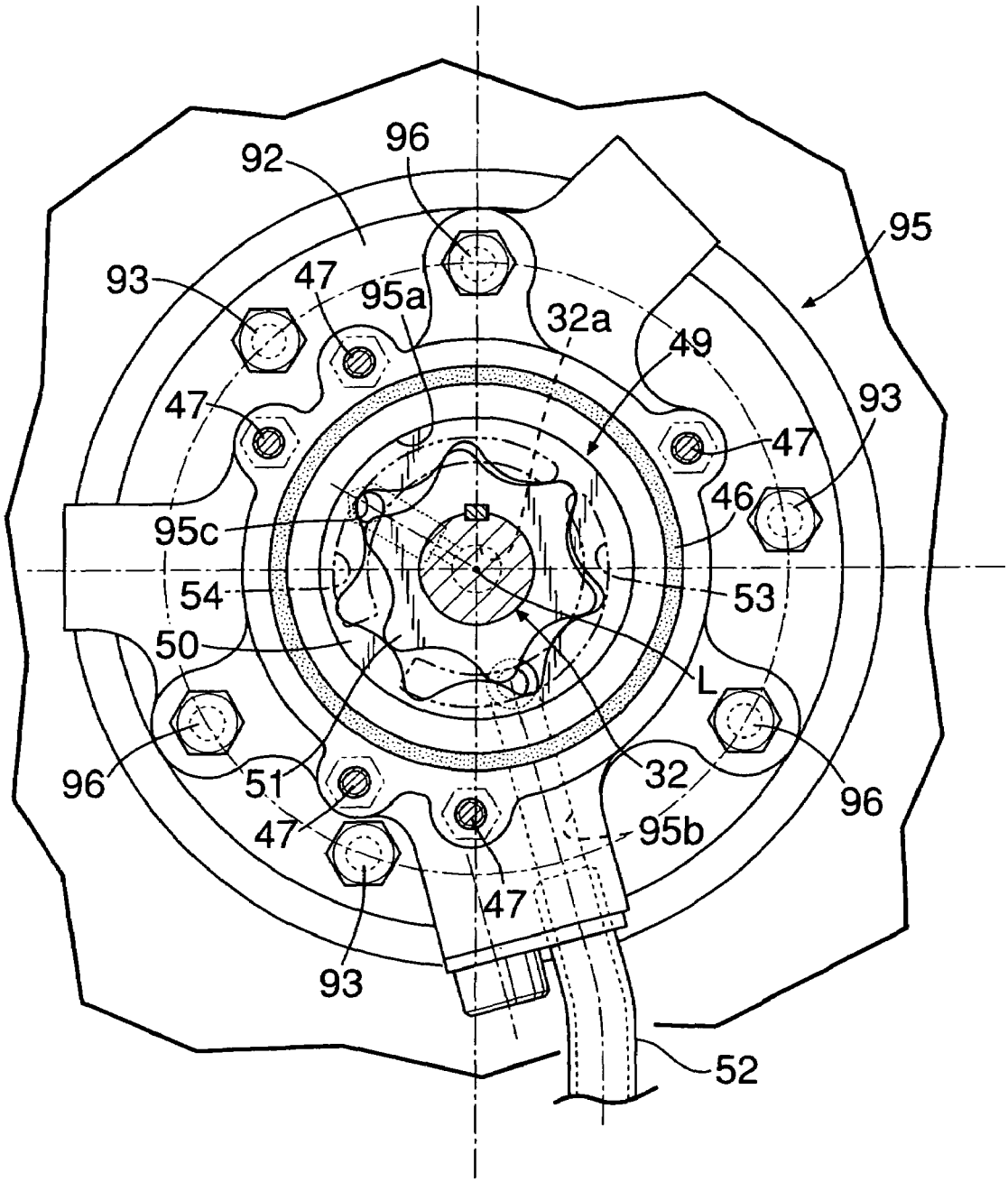
Figure 4:
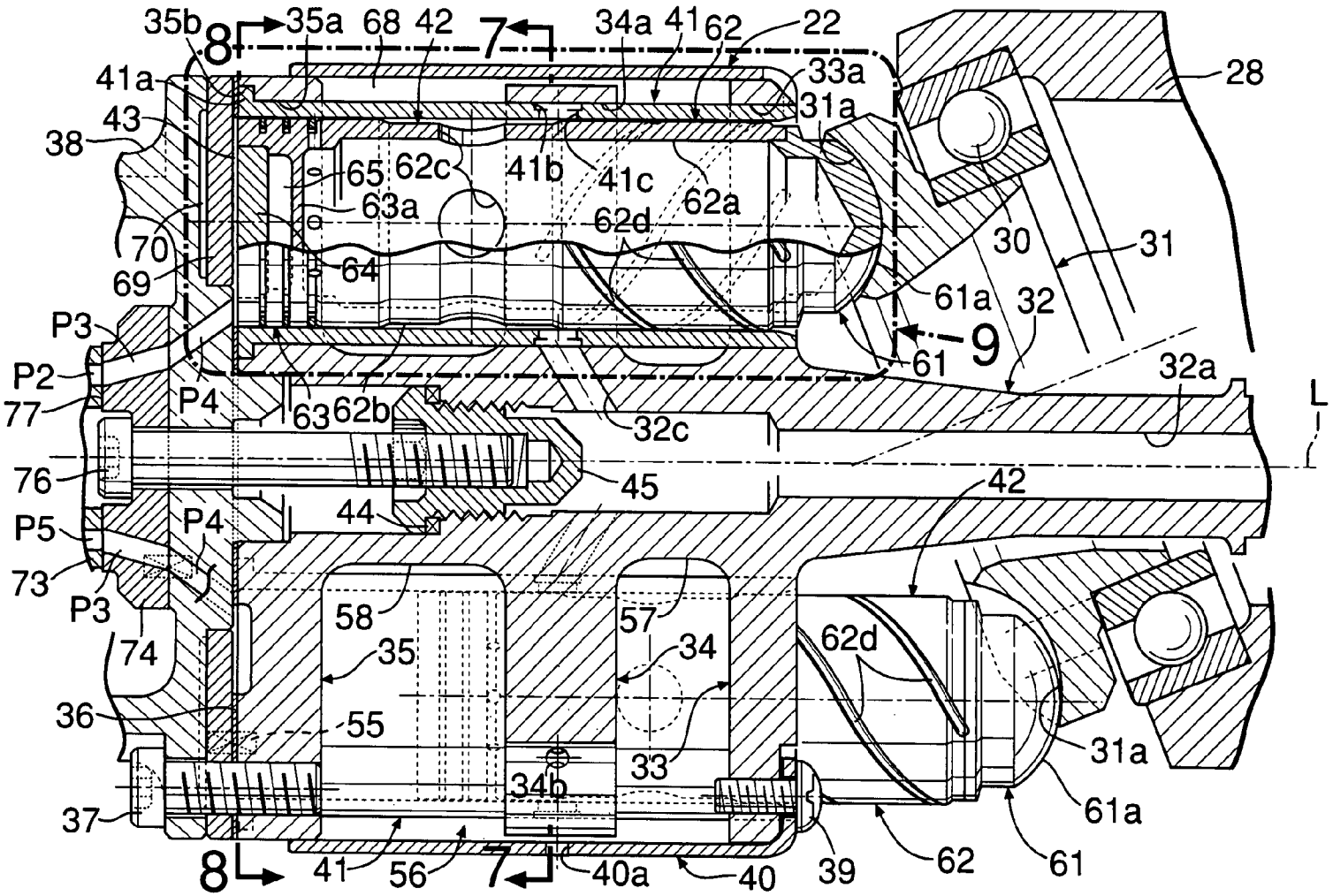

A first embodiment of the present invention will be explained hereinafter based on FIG. 1 to FIG. 15.

As shown in FIG. 1 to FIG. 9, an expansion machine E of this embodiment is used in, for example, a Rankine cycle apparatus, and converts thermal energy and pressure energy of high-temperature high-pressure steam as a working medium into mechanical energy and outputs it. A casing 11 of the expansion machine E is constructed by a casing body 12, a front cover 15 connected to a front surface opening of the casing body 12 with a plurality of bolts 14 . . . via a seal member 13, a rear cover 18 connected to a rear surface opening of the casing body 12 with a plurality of bolts 17 . . . via a seal member 16, and an oil pan 21 connected to a lower surface opening of the casing body 12 with a plurality of bolts 20 . . . via a seal member 19.

A rotor 22 rotatably disposed around an axis L extending in a longitudinal direction in a center of the casing 11 has its front portion supported by combination angular bearings 23*f* and 23*r* provided at the front cover 15, and has its rear portion supported by a radial bearing 24 provided at the casing body 12. A swash plate holder 28 is integrally formed on a rear surface of the front cover 15, and a swash plate 31 is rotatably supported at this swash holder 28 via an angular bearing 30. An axis of the swash plate 31 is inclined with respect to the axis L of the aforesaid rotor 22, and its inclination angle is fixed.

The rotor 22 includes an output shaft 32 supported at the front cover 15 with the combination angular bearings 23*f* and 23*r*, three sleeve supporting flanges 33, 34 and 35 integrally formed at a rear portion of the output shaft 32 via notches 57 and 58 (see FIG. 4 and FIG. 9) having predetermined widths from one another, a rotor head 38 connected to the sleeve support flange 35 at the rear side with a plurality of bolts 37 . . . via a metal gasket 36 and supported at the casing body 12 with the aforesaid radial bearing 24, and a heat insulation cover 40 fitted onto the three sleeve supporting flanges 33, 34 and 35 from the front and connected to the sleeve supporting flange 33 at the front side with a plurality of bolts 39 . . . .

Five sleeve supporting holes 33*a* . . . , five sleeve supporting holes 34*a* . . . , and five sleeve supporting holes 35*a* . . . are respectively formed in the three sleeve supporting flanges 33, 34 and 35 spaced at 72° around the axis L, and five cylinder sleeves 41 . . . are fitted into these sleeve supporting holes 33*a* . . . , 34*a* . . . and 35*a* . . . from the rear. A flange 41*a* is formed at a rear end of each of the cylinder sleeves 41, and the flange 41*a* abuts to the metal gasket 36 in the state in which the flange 41*a* is fitted into a step portion 35*b* formed at the sleeve supporting hole 35*a* of the sleeve supporting flange 35 at the rear side to be positioned in the axial direction (see FIG. 9). A piston 42 is slidably fitted into an inside of each of the cylinder sleeves 41. A front end of the piston 42 abuts to a dimple 31*a* formed on the swash plate 31, an expansion chamber 43 for steam is defined between the rear end of the piston 42 and the rotor head 38.

A plate-shaped bearing holder 92 is overlaid on the front surface of the front cover 15 with bolts 93 . . . via a seal member 91, and a pump body 95 is overlaid on a front surface of the bearing holder 92 with bolts 96 . . . via a seal member 94. The combination angular bearings 23*f* and 23*r* are sandwiched between a step portion of the front cover 15 and the bearing holder 92 and fixed in the direction of the axis L.

A shim 97 with a predetermined thickness is held between a flange 32*d* formed at the output shaft 32 for supporting the combination angular bearings 23*f* and 23*r*, and an inner race of the combination angular bearings 23*f* and 23*r*, and the inner race of the combination angular bearings 23*f* and 23*r* is fastened with a nut 98 screwed onto an outer periphery of the output shaft 32. As a result, the output shaft 32 is positioned in the direction of the axis L with respect to the combination angular bearings 23*f* and 23*r*, namely, with respect to the casing 11.

The combination angular bearings 23*f* and 23*r* are attached in an opposite direction from each other, and they not only support the output shaft 32 in a radial direction, but also support it in the direction of the axis L immovably. Namely, they are disposed so that the one combination angular bearing 23*f* restricts the forward movement of the output shaft 32, and the other combination angular bearing 23*r* restricts the rearward movement of the output shaft 32.

Since the combination angular bearings 23*f* and 23*r* are used for the bearing for supporting the front portion of the rotor 22, one of the loads exerted onto opposite sides in the direction of the axis L, which generate in the expansion chamber 43 . . . in a predetermined operation state of the expansion machine E, is transmitted to the inner race of the combination angular bearings 23*f* and 23*r* via the rotor 22, and the other is transmitted to an outer race of the combination angular bearings 23*f* and 23*r* via the swash plate 31 and the swash plate holder 28 of the front cover 15. These two loads compress the swash plate holder 28 of the front cover 15 sandwiched by the angular bearing 30 for supporting the swash plate 31 and the combination angular bearings 23*f* and 23*r* for supporting the rotor 22, and thus rigidity of the mechanism part is enhanced. In addition, the swash plate holder 28 is constructed integrally with the front cover 15 as in this embodiment, whereby a simple structure with higher rigidity is provided.

By incorporating the angular bearing 30 for supporting the swash plate 31 and the combination angular bearings 23*f* and 23*r* for supporting the rotor 22 into the front cover 15, an assembling operation can be performed by such units as "the rotor 22 and the piston 42 . . . ", "assembly of the front cover 15", and "a pump body 95", and efficiency of the operations such as reassembling of the piston 42 . . . and replacement of the oil pump 49 is improved. The radial bearing 24 for supporting the rotor head 38 constituting a rear end portion of the rotor 22 is a normal ball bearing for supporting only the load in the radial direction, and a clearance $\alpha$ (see FIG. 5) is formed between the rotor head 38 and an inner race of the radial bearing 24 so that the rotor head 38 can slide in the direction of the axis L with respect to the radial bearing 24.

An oil passage 32*a* extending on the axis L is formed inside the output shaft 32 integrated with the rotor 22, and a front end of the oil passage 32*a* branches in the radial direction and communicates with an annular groove 32*b* on an outer periphery of the output shaft 32. At a position which is inside in the radial direction of the central sleeve supporting flange 34 of the rotor 22, an oil passage blocking member 45 is screwed into an inner periphery of the aforesaid oil passage 32*a* via a seal member 44, and a plurality of oil holes 32*c* . . . extending outward in the radial direction from the oil passage 32*a* in the vicinity of the oil passage blocking member 45 are opened to an outer periphery surface of the output shaft 32.

A trochoid type oil pump 49, which is disposed between a recessed portion 95*a* formed on a front surface of the pump body 95 and a pump cover 48 fixed to the front surface of the pump body 95 with a plurality of bolts 47 . . . via a seal member 46, includes an outer rotor 50 rotatably fitted in the aforesaid recessed portion 95*a*, and an inner rotor 51 fixed to the outer periphery of the output shaft 32 and meshed with the outer rotor 50. An interior space of the oil pan 21 communicates with a suction port 53 of the oil pump 49 via an oil pipe 52 and an oil passage 95*b* of the pump body 95, and a discharge port 54 of the oil pump 49 communicates with the annular groove 32*b* of the output shaft 32 via an oil passage 95*c* of the pump body 95.

The piston 42 slidably fitted into the cylinder sleeve 41 is constituted of an end portion 61, an intermediate portion 62 and a top portion 63. The end portion 61 is the member having a spherical surface portion 61*a* which abuts to the dimple 31*a* of the swash plate 31, and is joined to a tip end of the intermediate portion 62 by welding. The intermediate portion 62 is a cylindrical member having a high-volume hollow space 62*a*, and has a small diameter portion 62*b* with a diameter being slightly reduced on an outer periphery portion near the top portion 63. A plurality of oil holes 62*c* . . . are formed to penetrate through the small diameter portion 62*b* in the radial direction, and a plurality of spiral oil grooves 62*d* . . . are formed on the outer periphery portion ahead of the small diameter portion 62*b*. The top portion 63 facing the expansion chamber 43 is formed integrally with the intermediate portion 62, and a heat insulating space 65 (see FIG. 9) is formed between a partition wall 63*a* formed on an inner surface of the top portion 63 and a lid member 64 fitted into a rear end surface of the top portion 63 and welded thereto. Two compression rings 66 and 66 and an oil ring 67 are attached to an outer periphery of the top portion 63, and an oil ring groove 63*b* into which the oil ring 67 is fitted communicates with the hollow space 62*a* of the intermediate portion 62 via a plurality of oil holes 63*c*.

The end portion 61 and the intermediate portion 62 of the piston 42 are made of high carbon steel, and the top portion 63 is made of stainless steel. Among them, induction hardening is applied to the end portion 61 and quench hardening is applied to the intermediate portion 62. As a result, resistance to high contact pressure of the end portion 61 which abuts to the swash plate 31 under high contact pressure, abrasion resistance of the intermediate portion 62 which slides in contact with the cylinder sleeve 41 under severe lubricating conditions, and heat resistance and corrosion resistance of the top portion 63, which faces the expansion chamber 43 and is exposed to the high temperature and high pressure, are satisfied.

An annular groove 41*b* (see FIG. 6 and FIG. 9) is formed on an outer periphery of an intermediate portion of the cylinder sleeve 41, and a plurality of oil holes 41*c* . . . are formed in this annular groove 41*b*. Irrespective of the mounting position of the cylinder sleeve 41 in a rotating direction, the oil holes 32*c* . . . formed in the output shaft 32 and oil holes 34*b*. (see FIG. 4 and FIG. 6) formed in the central sleeve supporting flange 34 of the rotor 22 communicate with the annular groove 41*b*. A space 68, which is formed between the sleeve supporting flanges 33 and 35 at the front side and the rear side of the rotor 22, and the heat insulating cover 40, communicates with an internal space of the casing 11 via oil holes 40*a* . . . (see FIG. 4 and FIG. 7) formed in the insulation cover 40.

An annular lid member 69 is welded to a front side or the side of the expansion chambers 43 . . . of the rotor head 38 connected to the rear surface of the sleeve supporting flange 33 at the front side of the rotor 22 with the bolts 37 . . . , and an annular heat insulating space 70 (see FIG. 9) is defined on a back surface or a rear surface of the lid member 69. The rotor head 38 is positioned in the rotating direction with respect to the sleeve supporting flange 35 at the rear side by a knock pin 55.

The five cylinder sleeves 41 . . . , and the five pistons 42 . . . constitute an axial piston cylinder group 56 of the present invention.

Next, a structure of a rotary valve 71 for supplying and discharging steam to the five expansion chambers 43 . . . of the rotor 22 will be explained based on FIG. 5 and FIG. 10 to FIG. 15.

Figure 5:
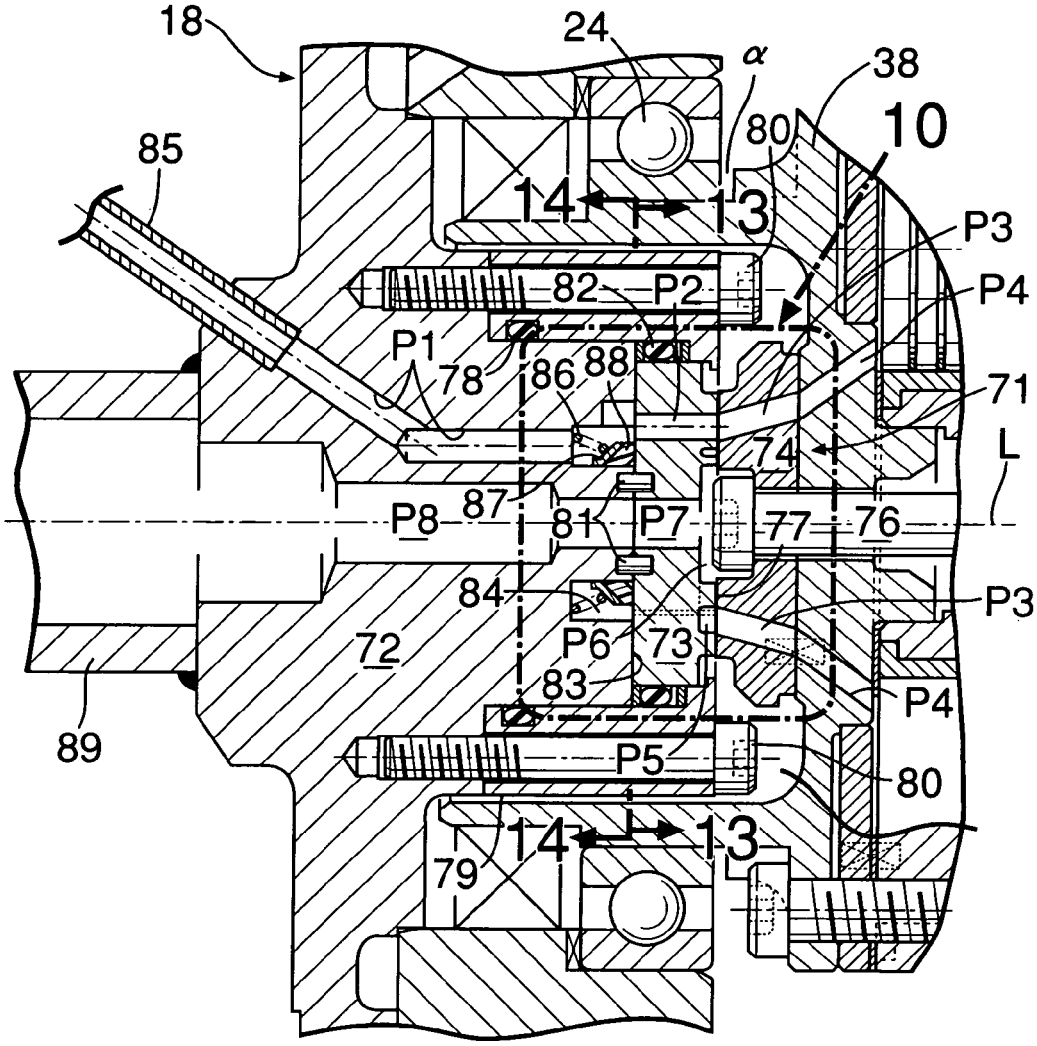
Figure 6:
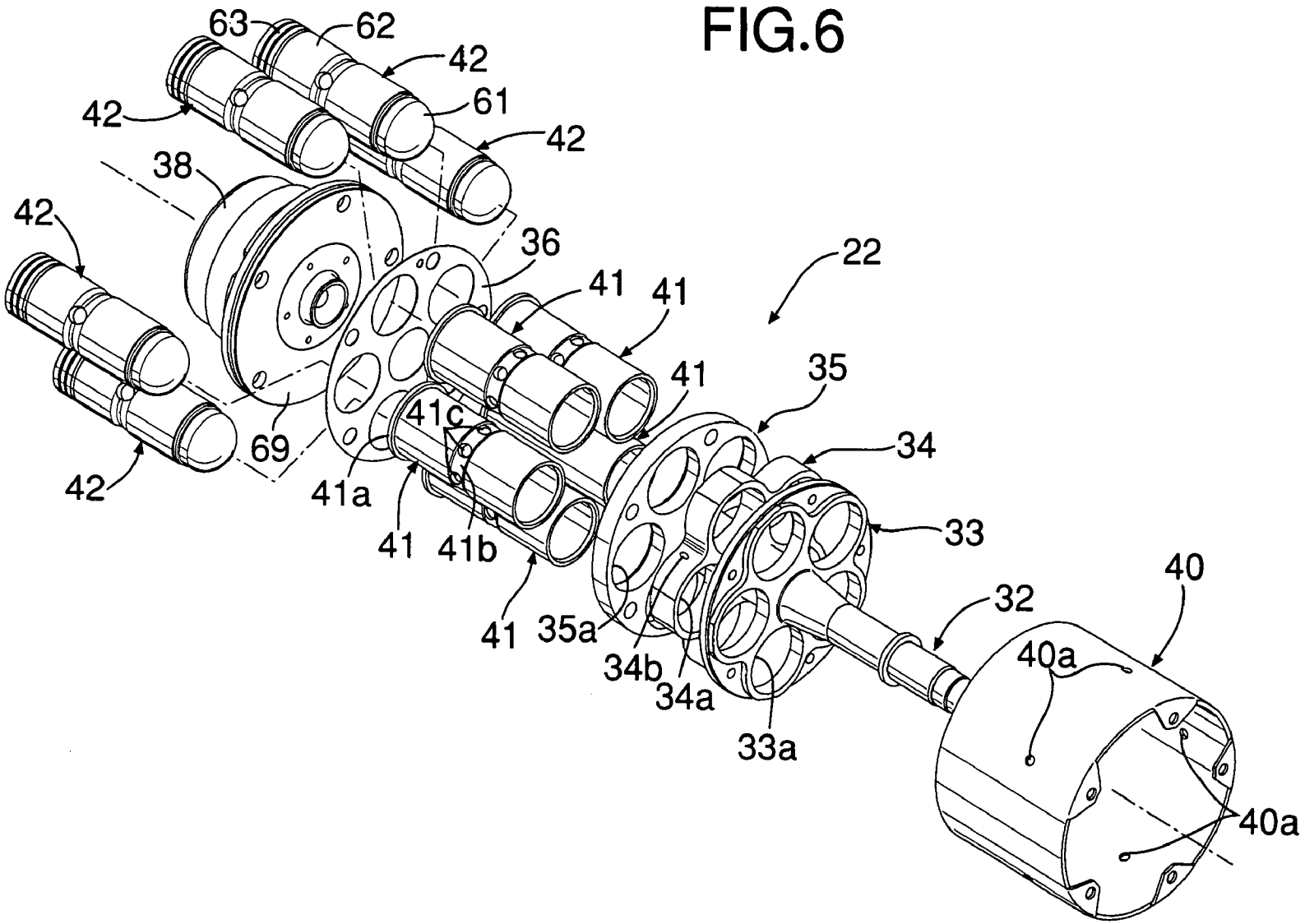
Figure 7:
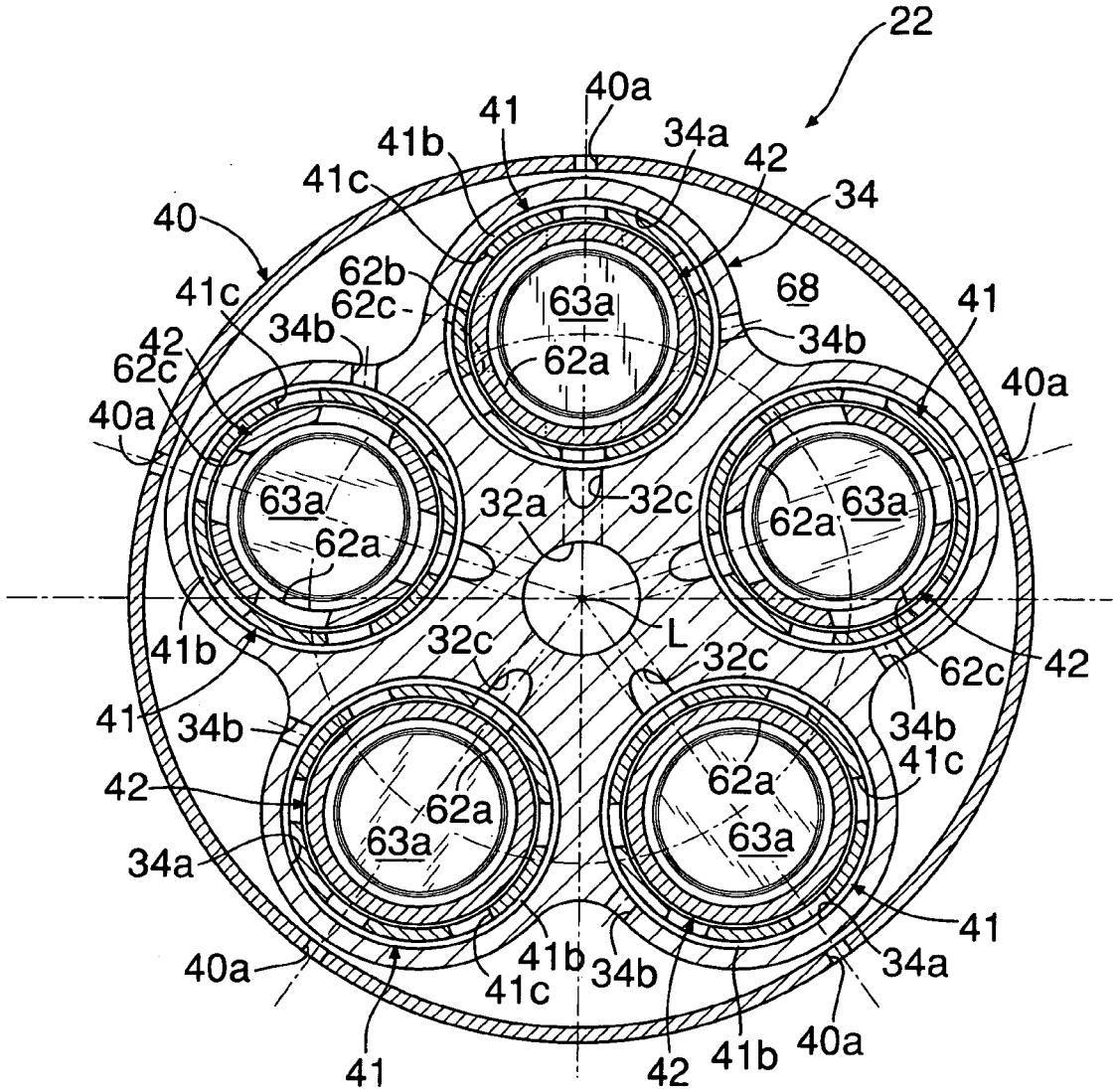
Figure 8:
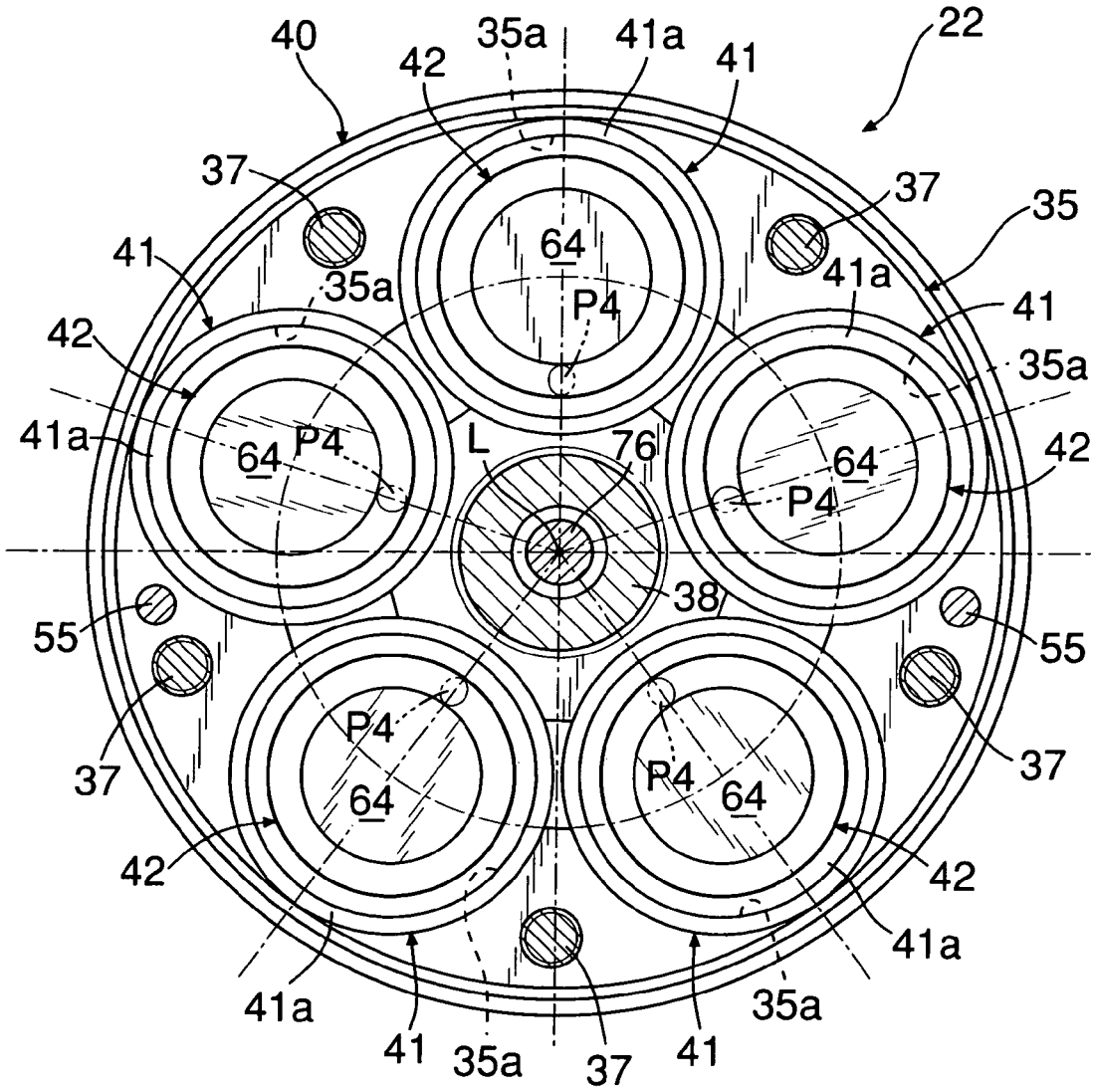
Figure 9:
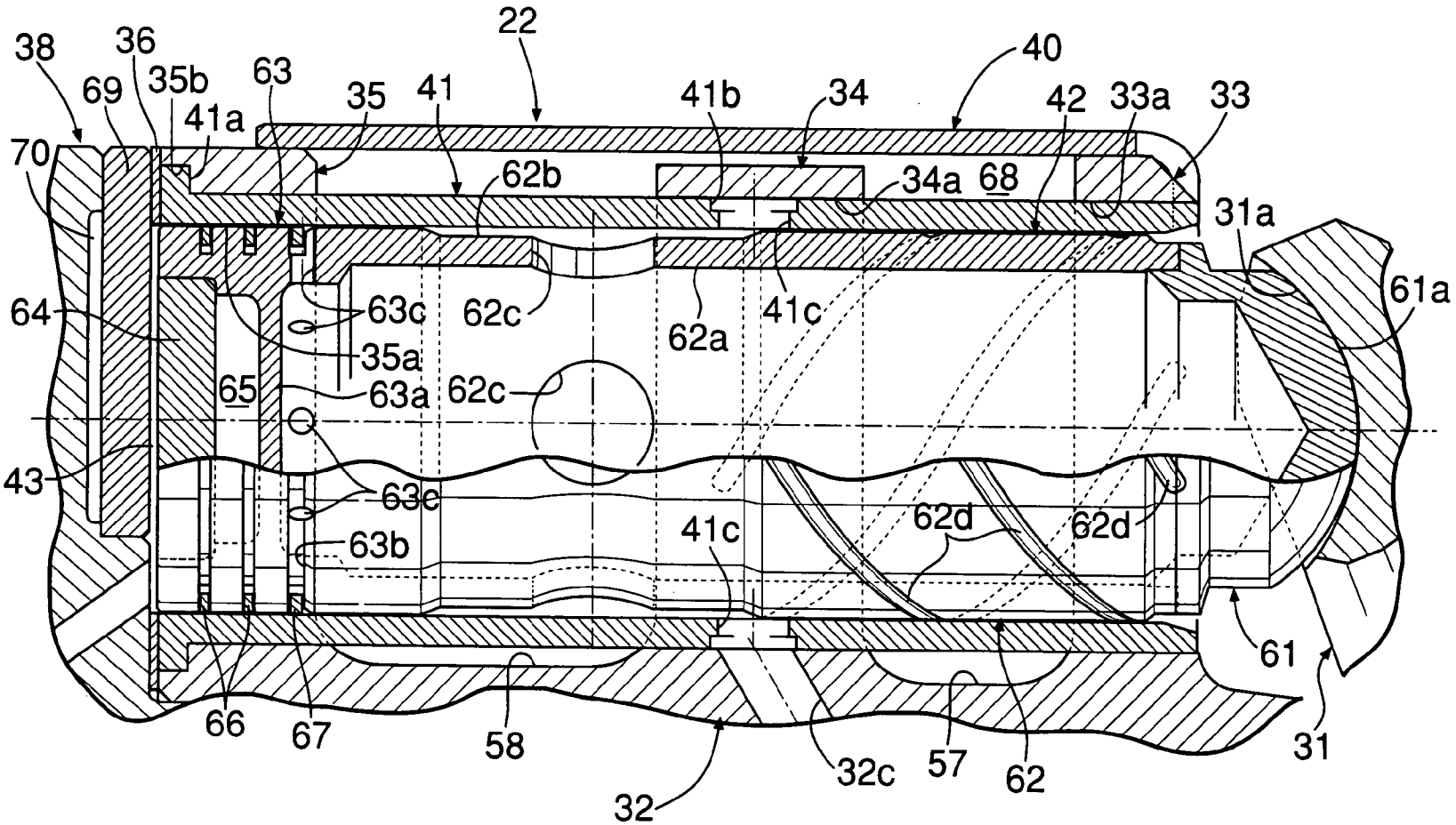

As shown in FIG. 5, the rotary valve 71 disposed along the axis L of the rotor 22 includes a valve body portion 72 integrally formed at a central portion of the rear cover 18, a fixed side valve plate 73 made of carbon, and a movable side valve plate 74 made of carbon, Teflon, metal or the like. The movable side valve plate 74 is fixed to the rear surface of the rotor 22 with a bolt 76 screwed into the oil passage blocking member 45 (see FIG. 4) in the state in which it is positioned in the rotating direction with a knock pin 75 (see FIG. 10). The bolt 76 also has a function of fixing the rotor head 38 to the output shaft 32.

An annular holder 79 fitted onto an outer periphery of the valve body 72 via a seal member 78 is fixed thereto with a plurality of bolts 80 . . . , and the fixed side valve plate 73, which is stopped from rotating by two knock pins 81 and 81 is supported inside this holder 79 via a seal member 82. A backup ring 90 disposed at a rear side of the seal member 82 has the role of protecting the seal member 82 vulnerable to heat from the heat of high-temperature and high-pressure steam, and a backup ring 91 disposed at a front side of the seal member 82 has a role of preventing the seal member 82 from falling off from a front end of the holder 79 due to the pressure of high-temperature and high-pressure steam. Both or only one of these backup rings 90 and 91 may be provided in accordance with the temperature and pressure of the high-temperature and high-pressure steam.

A flange 79*a* protruded inwardly in a radial direction from a front end of the holder 79 opposes a front surface of the fixed side valve plate 73 via a clearance β (see FIG. 10), and the fixed side valve plate 73 is movable in the direction of the axis L within a range of the clearance β. Since coating of a material having self lubricity such as Teflon is applied to the knock pins 81 and 81, the fixed side valve plate 73 can move smoothly in the direction of the axis L. Since the knock pins 81 and 81 are provided at a substantially center position of the fixed side valve plate 73, rotating torque applied to them becomes small, which makes it possible to reduce the size, and enables them to follow oscillation of the fixed side valve plate 73 easily. In addition, the seal member 82 has a collapse margin in the radial direction, and therefore substantially floating support of the fixed side valve plate 73 in the radial direction and the direction of the axis L can be performed while damping property is exhibited.

Figure 10:
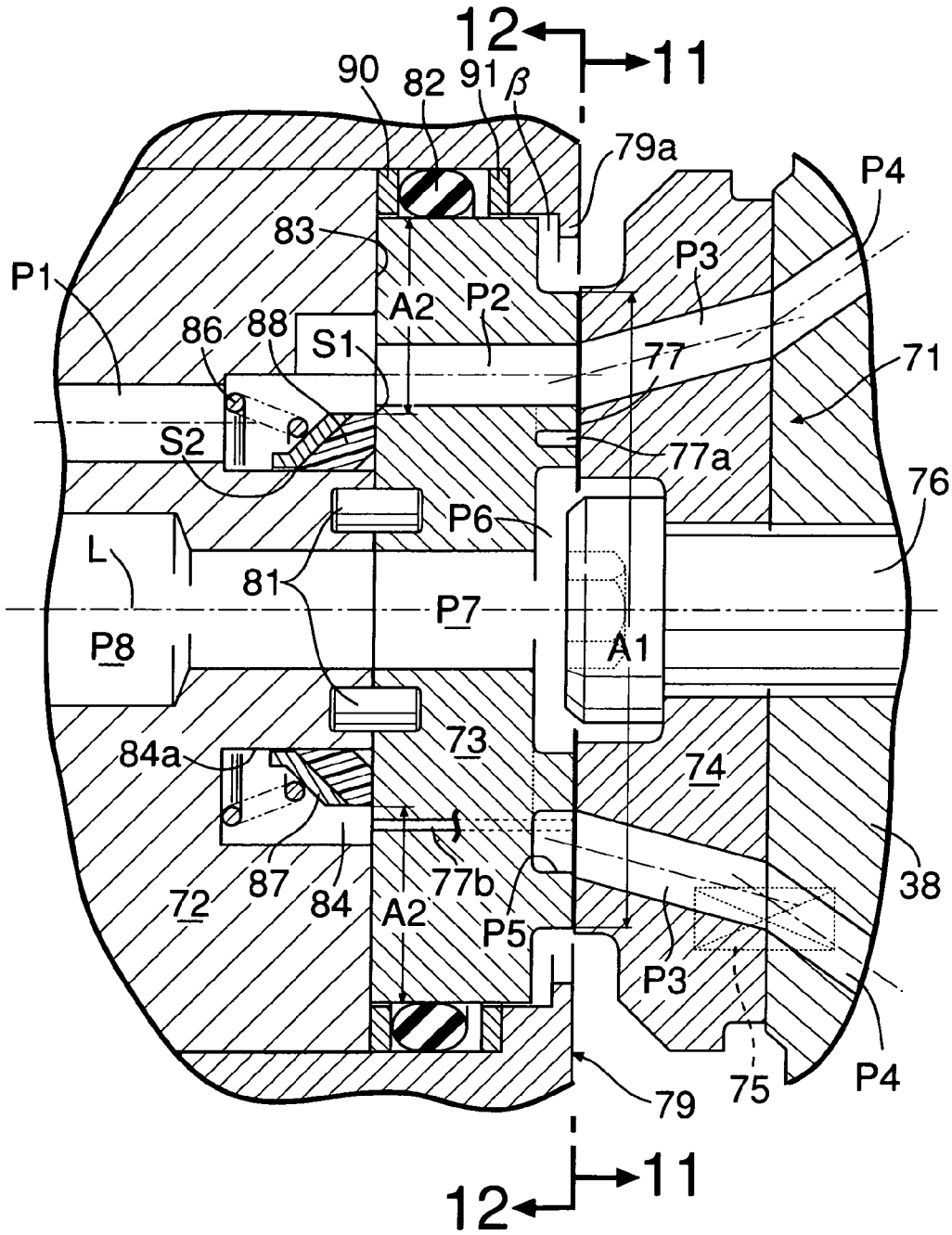
Figure 11:
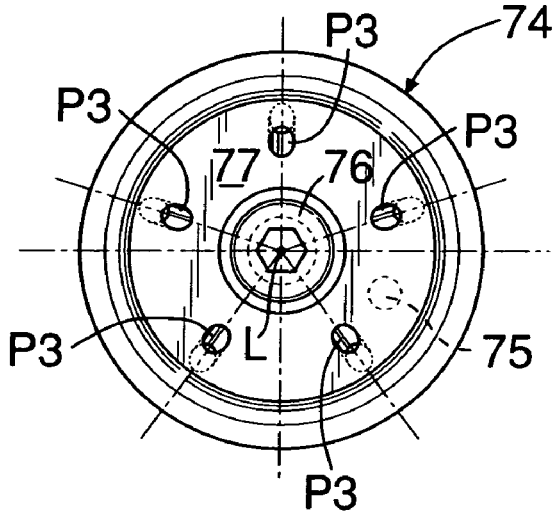

As is apparent with reference to FIG. 5 in combination with FIG. 10, an annular pressure chamber 84 surrounding the axis L is opened to a mating surface 83 at which the valve body portion 72 abuts to the fixed side valve plate 73. A steam supplying pipe 85 connected to the valve body portion 72 at a position eccentric from the axis L communicates with the pressure chamber 84 via a first steam passage P1 penetrating through an inside of the valve body portion 72. Inside the pressure chamber 84, a coil spring 86, a packing retainer 87 and a V-packing 88 are sequentially disposed in the direction of the axis L.

Accordingly, the high-temperature and high-pressure steam introduced into the pressure chamber 84 is also introduced to the mating surface 83 and sealed by the seal member 82 of the outer periphery, whereby the mating surface 83 on a rear surface of the fixed side valve plate 73 also becomes an area exhibiting a pressing action to a slide surface 77.

Figure 15:
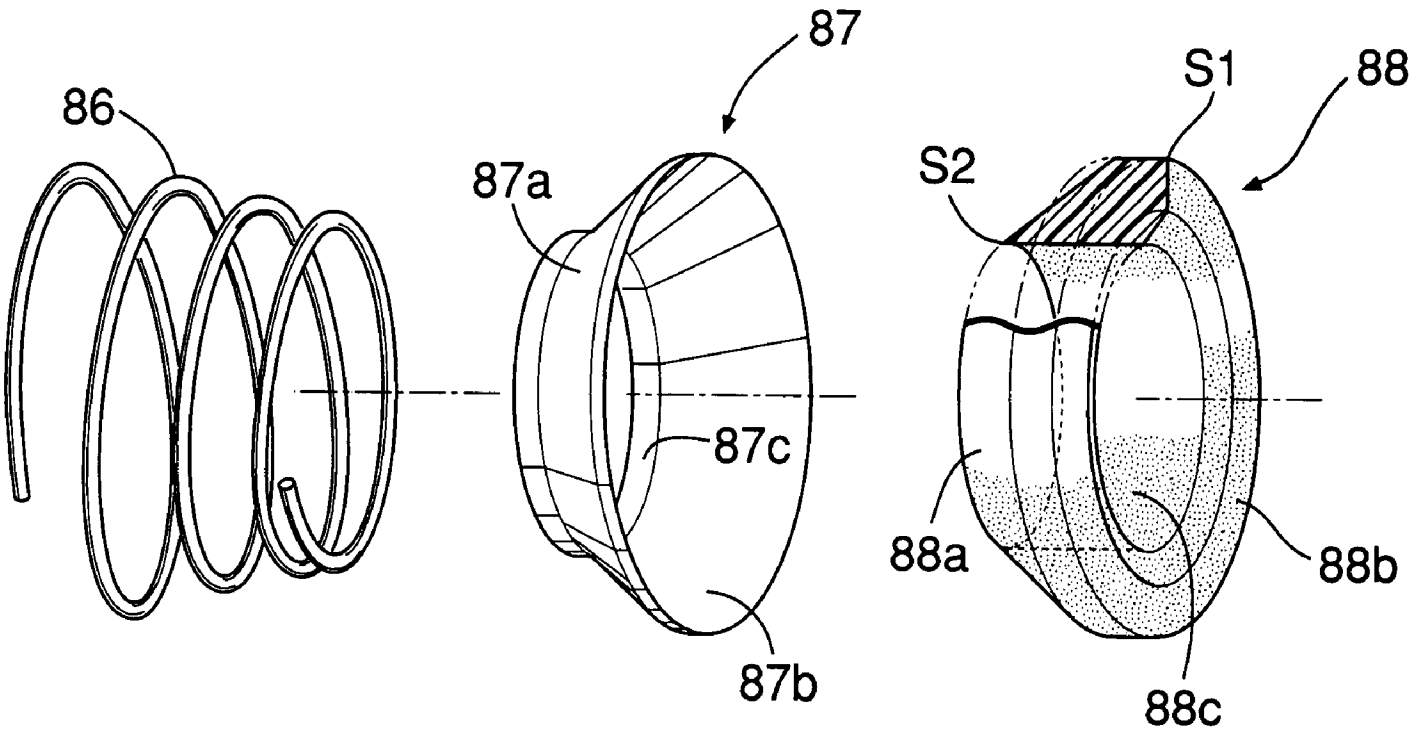
Figure 16:
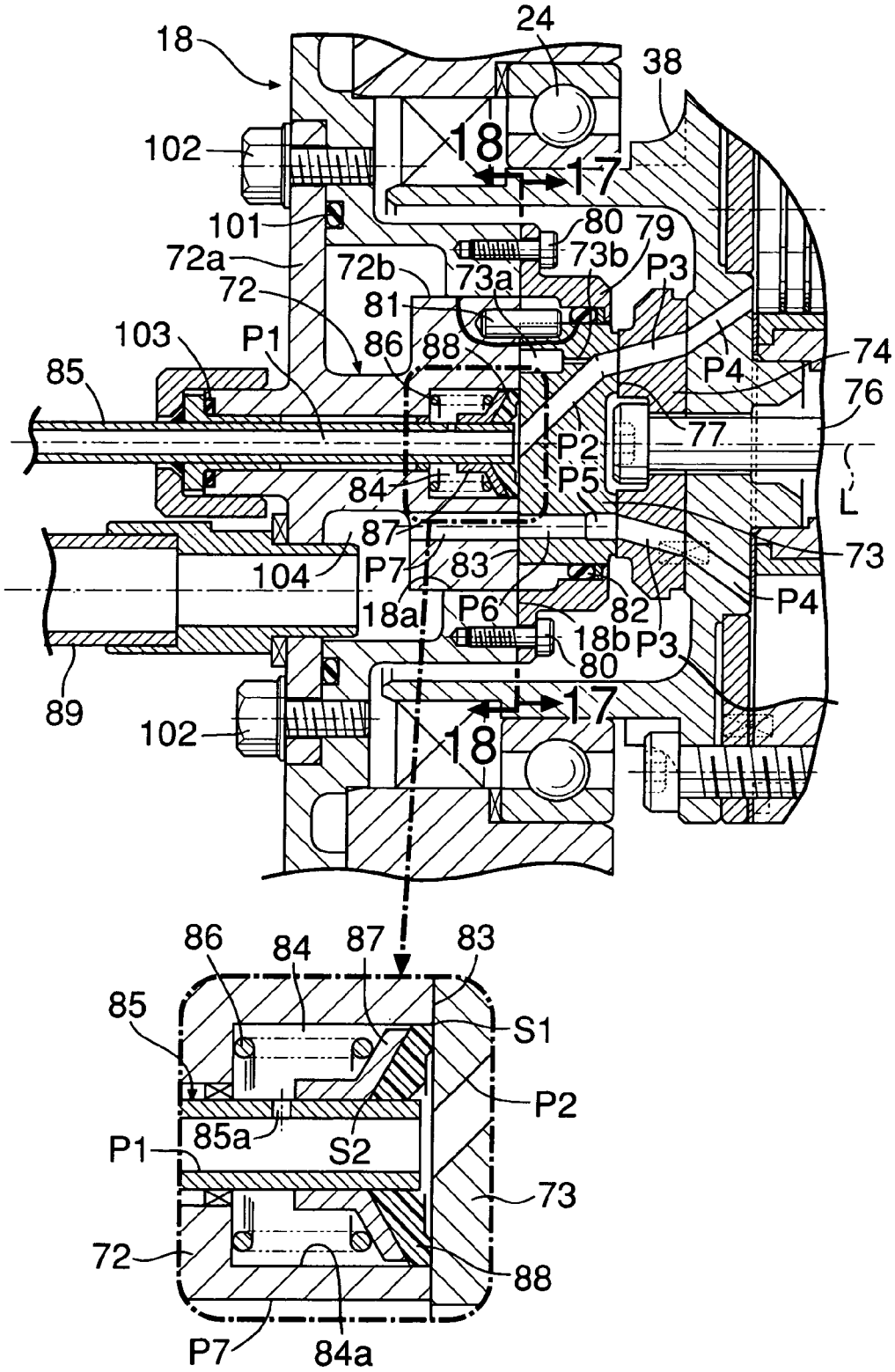
FIG. 16 to FIG. 19 show a second embodiment of the present invention.
Figure 17:
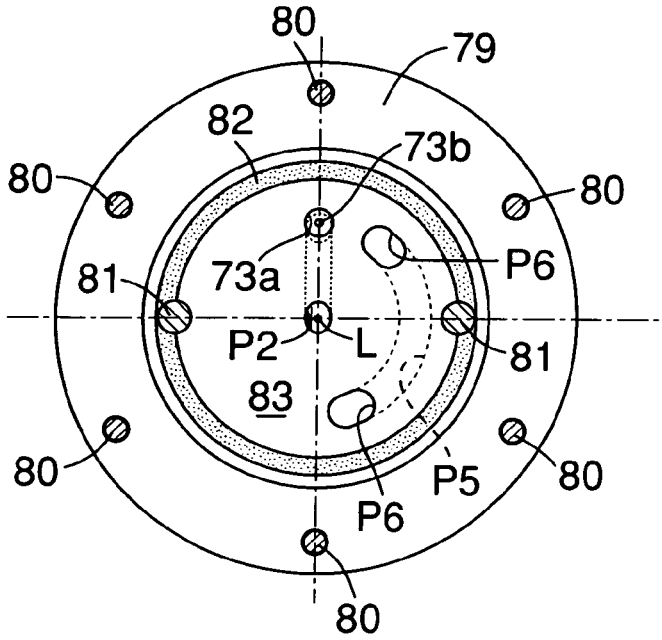
Figure 18:
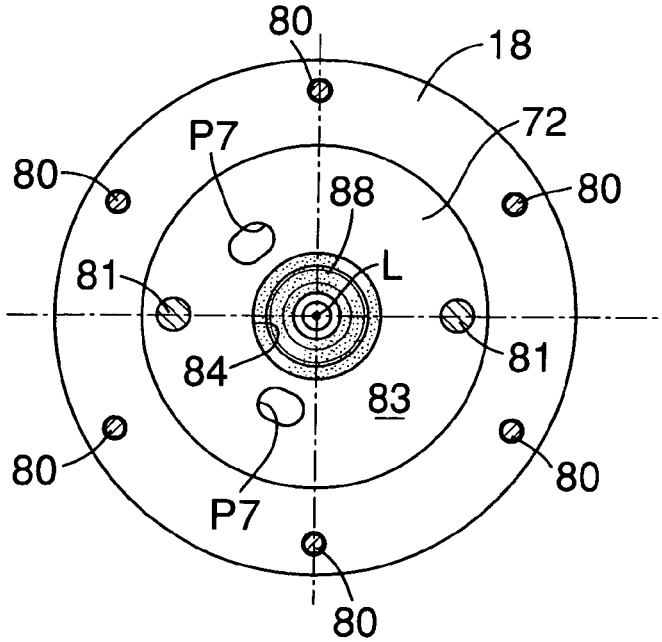
Figure 19:
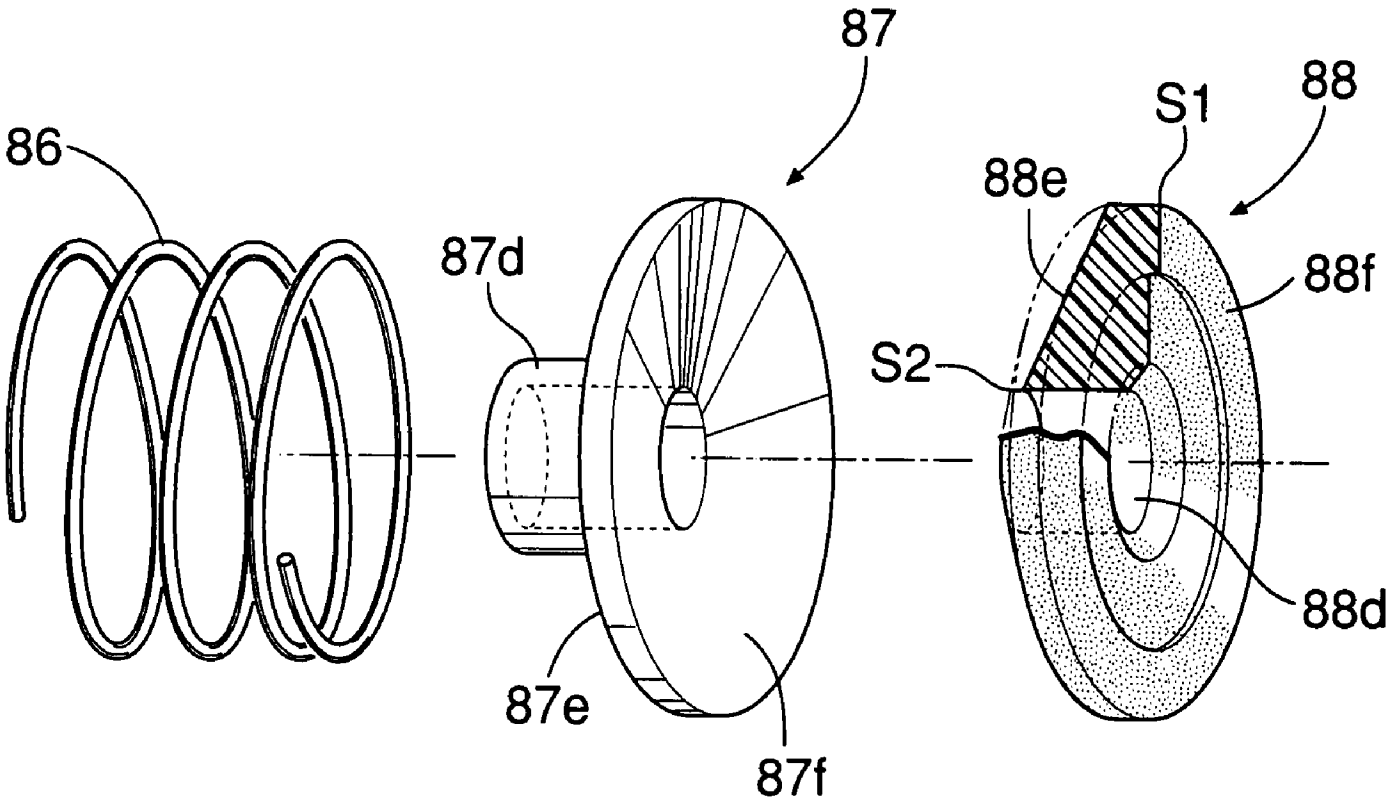

As is apparent from FIG. 15, the coil spring 86 is constructed by a taper coil spring with a winding diameter being reduced toward the fixed side valve plate 73. The metal packing retainer 87 includes a conical surface 87*a* to which the coil spring 86 abuts, a conical surface 87*b* for supporting the V-packing 88, on the opposite side of this conical surface 87*a*, and a circular opening 87*c* guided along an inner periphery surface 84*a* (see FIG. 10) of the pressure chamber 84 with a small clearance therebetween. The V-packing 88 made of a synthetic resin includes a conical surface 88*a* supported on the conical surface 87*b* of the packing retainer 87, a flat surface 88*b* abutting to the mating surface 83 with the fixed side valve plate 73, and a circular opening 88*c* guided to the inner periphery surface 84*a* of the pressure chamber 84.

The coil spring 86 has the functions of giving a preload to press the V-packing 88 against the mating surface 83 with the fixed side valve plate 73 before the pressure of the high-temperature and high-pressure steam rises, and of damping the vibration of the fixed side valve plate 73 by cooperation of the seal member 82 and the pressure of the high-temperature and high-pressure steam inside the pressure chamber 84. The packing retainer 87 has the functions of holding the V-packing 88 in a right position in the pressure chamber 84, and of enhancing durability of the V-packing 88 by insulating the V-packing 88 from the heat of the high-temperature and high-pressure steam.

The coil spring 86 has the structure in which a spring seat is abolished to take a large number of windings of spring in the small space within the pressure chamber 84, and does not directly abut to the packing 88, but the packing retainer 87 interposed between the coil spring 86 and the V-packing 88 is utilized as the spring seat, whereby it is made unnecessary to provide a special spring seat at the V-packing 88, and the size of the pressure chamber 84 in the direction of the axis L can be made compact while the maximum length of the coil spring 86 is secured. Further, the conical surfaces 87*a* and 87*b* of the packing retainer 87 exhibit the function of enhancing the following performance to the oscillation of the fixed side valve plate 73 in cooperation with the tapered coil spring 86 and the V-packing 88.

The first steam passage P1 formed in the valve body portion 72 communicates with the slide surface 77 via a second steam passage P2 formed in the fixed side valve plate 73. An arc-shaped fifth steam passage P5 and a circular sixth steam passage P6 which communicate with each other are concavely provided on the slide surface 77, and the sixth steam passage P6 communicates with the mating surface 83 via a seventh steam passage P7 formed on the axis L. An eighth steam passage P8 formed in the valve body portion 72 so as to be positioned on the axis L communicates with the seventh steam passage P7 in the mating surface 83 at its one end, and communicates with a steam discharge pipe 89 on a rear end surface of the valve body portion 72. A diameter of the steam discharge pipe 89 is larger than a diameter of the steam supply pipe 85, because low-temperature and low-pressure steam after expansion increases in volume as compared with the high-temperature and high-pressure steam before expansion.

Figure 12:
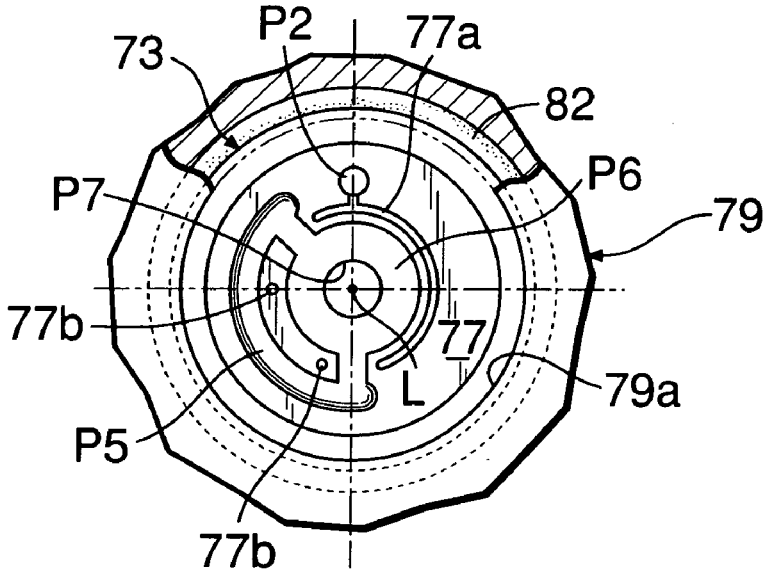
Figure 13:
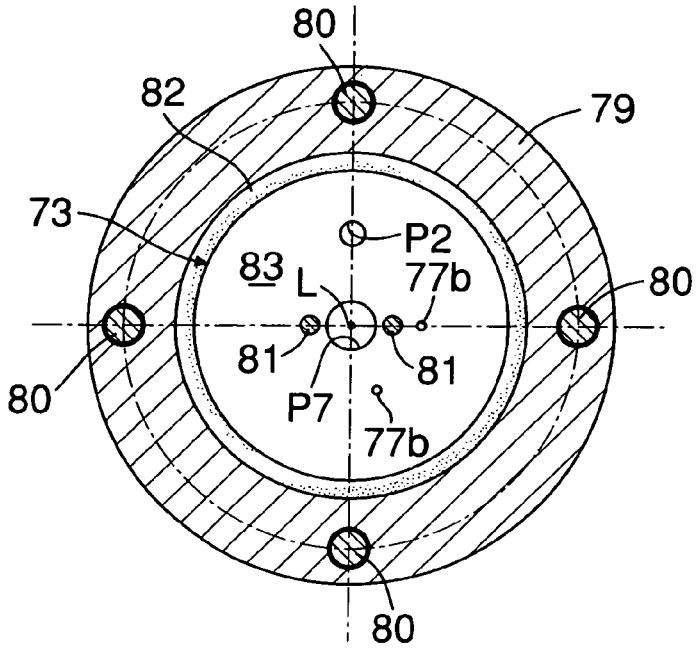
Figure 14:
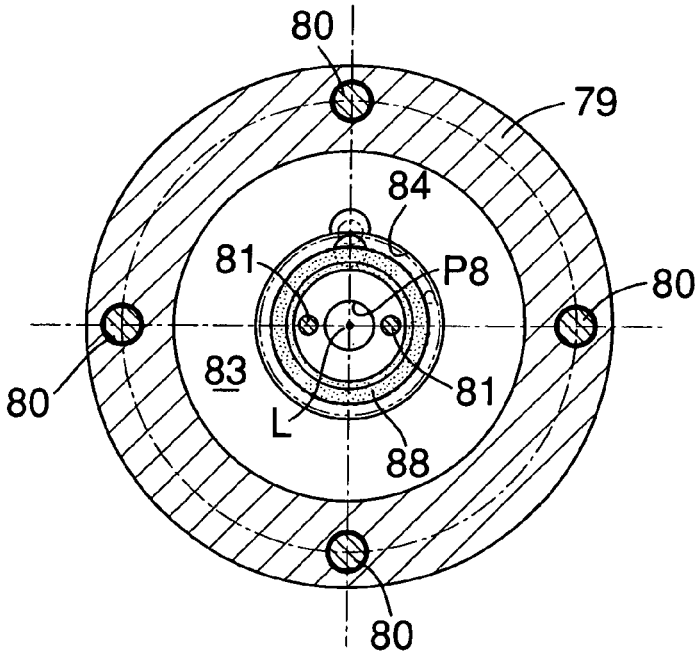

As is well shown in FIG. 10 and FIG. 12, on the slide surface 77 of the fixed side valve plate 73, an arc-shaped pressure groove 77*a* communicating with the second steam passage P2 is concavely provided, and two pressure holes 77*b* and 77*b* penetrating through the fixed side valve plate 73 to communicate with the pressure chamber 84 are opened.

Five third steam passages P3 . . . disposed equidistantly to surround the axis L penetrate through the movable side valve plate 74, and opposite ends of five of fourth steam passages P4 . . . , which is formed in the rotor 22 to surround the axis L, communicate with the aforesaid third steam passages P3 . . . , and the aforesaid expansion chambers 43 . . . , respectively. While a portion of the second steam passage P2, which is opened to the slide surface 77, is circular, a portion of the fifth steam passage P5, which is opened to the slide surface 77, is formed in an arc shape having the axis L as the center.

Next, an operation of the expansion machine E of this embodiment including the above-described construction will be explained.

The high-temperature and high-pressure steam generated by heating water in an evaporator reaches the slide surface 77 with the movable side valve plate 74 from the steam supply pipe 85 via the first steam passage P1, the pressure chamber 84 and the mating surface 83 of the valve body portion 72, and the second steam passage P2 of the fixed side valve plate 73. Then, the second steam passage P2 opened to the slide surface 77 instantly communicates with the corresponding third steam passage P3 formed in the movable side valve plate 74 rotating integrally with the rotor 22 in a predetermined intake period, and the high-temperature and high-pressure steam is supplied to the expansion chamber 43 in the cylinder sleeve 41 from the third steam passage P3 via the fourth steam passage P4 formed in the rotor 22.

The high-temperature and high-pressure steam expands in the expansion chamber 43 after communication of the second steam passage P2 and the third steam passage P3 is shut off following the rotation of the rotor 22, whereby the piston 42 fitted into the cylinder sleeve 41 is pushed out forward from the upper dead center to the lower dead center, and the end portion 61 at its front end presses the dimple 31*a* of the swash plate 31. As a result, rotating torque is given to the rotor 22 by a reaction force which the piston 42 receives from the swash plate 31. Each time the rotor 22 turns a one fifth of a turn, the high-temperature and high-pressure steam is supplied into the next expansion chamber 43 adjacent to each other, so that the rotor 22 is rotationally driven continuously.

While the piston 42 reaching the lower dead center following the rotation of the rotor 22 retreats toward the upper dead center by being pressed by the swash plate 31, the low-temperature and low-pressure steam pushed out of the expansion chamber 43 is supplied to a condenser via the fourth steam passage P4 of the rotor 22, the third steam passage P3 of the movable side valve plate 74, the slide surface 77, the fifth steam passage P5, the sixth steam passage P6 and the seventh steam passage P7 of the fixed side valve plate 73, the mating surface 83, the eighth steam passage P8 of the valve body portion 72, and the steam discharge pipe 89.

Following the rotation of the rotor 22, the oil pump 49 provided at the output shaft 32 is operated, the oil sucked from the oil pan 21 via the oil pipe 52, the oil passage 95*b* of the pump body 95, and the suction port 53 is discharged from the discharge port 54, and is supplied into a space between the reduced diameter portion 62*b* formed in the intermediate portion 62 of the piston 42 and the cylinder sleeve 41 via the oil passage 95*c* of the pump body 95, the oil passage 32*a* of the output shaft 32, the annular groove 32*b* of the output shaft 32, the oil holes 32*c* . . . of the output shaft 32, the annular groove 41*b* of the cylinder sleeve 41 and the oil holes 41*c* . . . of the cylinder sleeve 41. Part of the oil held in the aforesaid reduced diameter portion 62*b* flows into the spiral oil grooves 62*d* . . . formed in the intermediate portion 62 of the piston 42 to lubricate the slide surface with the cylinder sleeve 41, and the other part of the aforesaid oil lubricates slide surfaces of the compression rings 66 and 66 and the oil ring 67 provided at the top portion 63 of the piston 42, and the cylinder sleeve 41.

It is inevitable that the water resulting from condensed part of the supplied high-temperature and high-pressure steam enters the slide surfaces of the cylinder sleeve 41 and the piston 42 from the expansion chamber 43 and gets into oil, and therefore the lubrication conditions of the aforesaid slide surfaces become severe. However, by directly supplying a necessary amount of oil to the slide surfaces of the cylinder sleeve 41 and the piston 42 from the oil pump 49 through the inside of the output shaft 32, sufficient oil film is kept to secure lubricating performance, and the oil pump 49 can be made compact.

The oil scraped from the slide surfaces of the cylinder sleeve 41 and the piston 42 by the oil ring 67 flows into the hollow space 62*a* inside the piston 42 from the oil holes 63*c* . . . formed at the bottom portion of the oil ring groove 63*b*. The aforesaid hollow space 62*a* communicates with the inside of the cylinder sleeve 41 via a plurality of oil holes 62*c* . . . penetrating through the intermediated portion 62 of the piston 42, and the inside of the cylinder sleeve 41 communicates with the annular groove 41*b* on the outer periphery of the cylinder sleeve 41 via a plurality of oil holes 41*c* . . . . The periphery of the annular groove 41*b* is covered with the central sleeve supporting flange 34 of the rotor 22, but since the oil hole 34*b* is formed in the sleeve supporting flange 34, the oil in the hollow space 62*a* of the piston 42 is biased outward in the radial direction by the centrifugal force to be discharged into the space 68 in the heat insulating cover 40 through the oil hole 34*b* of the sleeve supporting flange 34, and returned to the oil pan 21 through the oil holes 40*a* . . . of the heat insulating cover 40 from the space 68. On this occasion, the aforesaid oil hole 34*b* is at the position eccentric to the axis L from the outer end of the sleeve supporting flange 34 in the radial direction, and therefore the oil in the outside in the radial direction from the oil hole 34*b* is held in the hollow space 62*a* of the piston 42 by the centrifugal force.

As described above, the oil held in the hollow space 62*a* inside the piston 42 and the oil held in the reduced diameter portion 62*b* on the outer periphery of the piston 42 are supplied from the aforesaid reduced diameter portion 62*b* to the top portion 63 in the expansion stroke in which the volume of the expansion chamber 43 increases, and are supplied from the aforesaid reduced diameter portion 62*b* to the end portion 61 in the compression stroke in which the volume of the expansion chamber 43 decreases, and therefore the entire area in the axial direction of the piston 42 can be reliably lubricated. The oil flows inside the hollow space 62*a* of the piston 42, whereby the heat of the top portion 63 exposed to the high-temperature and high-pressure steam is transmitted to the low-temperature end portion 61 to make it possible to avoid the temperature of the piston 42 from rising locally.

Since the heat insulating space 65 is formed between the top portion 63 of the piston 42, which faces the expansion chamber 43, and the intermediate portion 62, and the heat insulating space 70 is also formed in the rotor head 38 facing the expansion chamber 43, heat release from the expansion chamber 43 to the piston 42 and the rotor head 38 is minimized to make it possible to contribute to improvement in the performance of the expansion machine E, when the high-temperature and high-pressure steam is supplied to the expansion chamber 43 from the fourth steam passage P4. Since the hollow space 62*a* of a large volume is formed inside the piston 42, not only the weight of the piston 42 can be reduced, but also heat release from the expansion chamber 43 can be reduced further efficiently by decreasing thermal mass of the piston 42.

Since the metal gasket 36 is interposed between the rear side sleeve supporting flange 35 and the rotor head 38 to seal the expansion chamber 43, a dead volume around the seal can be reduced as compared with the case in which the expansion chamber 43 is sealed via an annular seal member with large thickness, whereby the large volume ratio (expansion ratio) of the expansion machine E is secured, and the thermal efficiency is enhanced to make it possible to enhance the output. Since the cylinder sleeve 41 is constructed as the separate body from the rotor 22, the material of the cylinder sleeve 41 can be selected in consideration of thermal conductivity, heat resistance, strength, abrasion resistance and the like without being limited to the material of the rotor 22, and only the worn or damaged cylinder sleeve 41 can be replaced, which is economical.

Since the outer periphery surface of the cylinder sleeve 41 is exposed from the two notches 57 and 58 formed on the outer periphery surface of the rotor 22 in the circumferential direction, not only the weight of the rotor 22 can be reduced, but also the thermal efficiency can be enhanced by decreasing the thermal mass of the rotor 22, and heat release from the cylinder sleeve 41 can be suppressed by making the notches 57 and 58 function as the heat insulating space. Since the outer periphery portion of the rotor 22 is covered with the heat insulating cover 40, heat release from the cylinder sleeve 41 can be suppressed further effectively.

The rotary valve 71 supplies and discharges steam to and from the axial piston cylinder group 56 via the flat slide surface 77 between the fixed side valve plate 73 and the movable side valve plate 74, and therefore leakage of the steam can be effectively prevented. This is because highly precise machining is easily performed for the flat slide surface 77, and thus adjustment of the clearance is easier as compared with a cylindrical slide surface.

It is inevitable that more or less inclination occurs to the rotor 22 by play of the combination angular bearings 23*f* and 23*r*, and the radial bearing 24 which support the rotor 22, due to thermal expansion especially at the time of high temperature, and the slide surface 77 of the movable side valve plate 74 fixed to the rotor 22 is not always strictly perpendicular to the axis L. Accordingly, the fixed side valve plate 73 abutting to the movable side valve plate 74 via the slide surface 77 slightly oscillates following the rotation of the rotor 22, and there arises the fear that close contactability of the slide surface 77 is impaired.

However, as is apparent from FIG. 10, when the high-temperature and high-pressure steam is supplied to the pressure chamber 84 from the first steam passage P1 of the valve body portion 72, a pressing load of the amount corresponding to an area A2 in which pressure of the pressure chamber 84 acts on the mating surface 83 is applied to the fixed side valve plate 73. The fixed side valve plate 73 is movable in the direction of the axis L in the range of the clearance β with respect to the valve body portion 72, and therefore the fixed side valve plate 73 is biased toward the movable side valve plate 74 with the aforesaid pressing load, thereby securing the close contactability of the slide surface 77. The area A2 in which the pressure of the pressure chamber 84 acts on the mating surface 83 includes the portion up to an outer end of the mating surface 83 sealed by the seal member 82.

At this time, the first seal lip S1 on the outer periphery portion of the V-packing 88 is bent forward in the direction of the axis L with the pressure of the high-temperature and high-pressure steam supplied to the pressure chamber 84, whereby a space from the mating surface 83 of the fixed side valve plate 73 is effectively sealed. Consequently, when the valve body portion 72 is thermally expanded in the direction of the axis L1 with the heat of the high-temperature and high-pressure steam, the V-packing 88 follows to move in the direction of the axis L, and the first seal lip S1 is elastically deformed by the pressure of the high-temperature and high-pressure steam, whereby sealing performance can be maintained. As a result, the high-temperature and high-pressure steam of the pressure chamber 84 is reliably prevented from leaking into the seventh and the eighth steam passages P7 and P8 at low pressure via the mating surface 83, thus contributing to improvement in the output of the expansion machine E. Especially because the first seal lip S1 formed on the outer periphery portion of the V-packing 88 is large in the length in the circumferential direction, it has a large pressure receiving area and can be effectively bent, and is reliably in contact with the fixed side valve plate 73 and the mating surface 83 to exhibit high sealing performance.

The second seal lip S2 of the inner periphery surface of the V-packing 88 abuts to the inner periphery surface 84*a* of the pressure chamber 84, but the eighth steam passage P8 in which the low-temperature and low-pressure working medium passes is formed at a portion inward from it. Consequently, the thermal extension of the aforesaid inner periphery surface 84*a* is comparatively small, and accordingly, the sealing performance of the second seal lip S2 of the V-packing 88 does not specially matter.

Since the coil spring 86 tapers toward the packing retainer 87, the packing retainer 87 and the V-packing 88 have damping property around the axis L to allow oscillation and are able to enhance close contactability of the slide surface 77. In addition, when the coil spring 86 extends and contracts following the vibration of the fixed side valve plate 73, the vibration of the fixed side valve plate 73 can be effectively damped by the resistance of the high-temperature and high-pressure steam inside the pressure chamber 84, in which the coil spring 86 is housed, in cooperation with the damping property of the seal member 82.

The eighth discharge passage P8 formed on the axis L in the valve body portion 72 cannot be made small in the diameter because the low-temperature and low-pressure steam after expansion passes through it, and therefore the area A2 in which the pressure of the pressure chamber 84 formed to surround the eighth discharge passage P8 acts to the mating surface 83 inevitably becomes large. As a result, there is the fear that the pressing load generated by the pressure chamber 84 becomes large and the contact pressure of the slide surface 77 becomes excessive. However, high pressure of the second steam passage P2 in which the high-temperature and high-pressure steam passes is guided to the pressure groove 77*a* opened to the slide surface 77 of the fixed side valve plate 73, and high pressure of the pressure chamber 84 is guided to the pressure holes 77*b* and 77*b* opened to the slide surface 77 of the fixed side valve plate 73, whereby the pressing load to the slide surface 77 is controlled, and the contact pressure of the slide surface 77 is prevented from rising excessively to make it possible to reduce frictional force and prevent abnormal abrasion.

When the pressure of the high-temperature and high-pressure steam supplied to the pressure chamber 84 becomes high, the high-temperature and high-pressure steam easily leaks out of the slide surface 77 of the fixed side valve plate 73 and the movable side valve plate 74, but the pressing load generated by the pressure chamber 84 increases corresponding to the increase in the pressure to enhance the contact pressure of the slide surface 77, so that sealing performance corresponding to the pressure of the high-temperature and high-pressure steam can be exhibited. Especially, in FIG. 10, the contact pressure of the slide surface 77 can be optionally adjusted by properly setting the ratio A2/A1 of the area A2, in which the pressure of the pressure chamber 84 acts on the mating surface 83, to the area A1 of the slide surface 77. Specifically, when the ratio A2/A1 is made large, the contact pressure of the slide surface 77 increases, and when the ratio A2/A1 is made small, the contact pressure of the slide surface 77 decreases.

Namely, the optimal pressing load is the pressing load with a small leak in the slide surface 77 being considered, which makes the expansion machine E exhibit the maximum output power, and is excellent in thermal efficiency, at the time when the pressure of the high-temperature and high-pressure steam supplied to the expansion chambers 43 . . . , and the pressing load are at the same pressure, with the balance ratio of $A2/A1 \leqq 1$. Since the pressure of the high-temperature and high-pressure steam supplied to the expansion chambers 43 . . . reduces in pressure by the expansion action soon after it is supplied there, it is suitable to consider the pressure of the pressure chamber 84 as the pressure which is not higher than the high-temperature and high-pressure just before being supplied to the expansion chambers 43 . . . , and set the pressing load to the slide surface 77.

Since in the embodiment mainly shown in FIG. 10, the knock pins 81 and 81 for stopping rotation are provided at the substantially center position of the rear surface of the fixed side valve plate 73, the fixed side valve plate 73 is movable in the direction of the axis L by the amount of the clearance β, and the fixed side valve plate 73 is movable in the radial direction by the amount of the collapse margin of the seal member 82, a large oscillation range of the fixed side valve plate 73 can be secured, which makes it especially suitable for the case with low steam pressure.

Further, the rotary valve 71 can be attached and detached to and from the casing body 12 by only removing the rear cover 18 from the casing body 12, and therefore the maintenance operability in repair, cleaning, replacement and the like is improved remarkably. The rotary valve 71 in which the high-temperature and high-pressure steam passes is at high temperature, but the swash plate 31 and the output shaft 32 requiring lubrication by oil are disposed at a side opposite from the rotary valve 71 with the rotor 22 therebetween, and therefore lubricating performance for the swash plate 31 and the output shaft 32 can be prevented from being reduced by the oil being heated by the heat of the rotary valve 71 at high temperature. The oil exhibits the function of cooling the rotary valve 71 to prevent overheating.

Incidentally, it is necessary to adjust the dimension of the dead volume between the bottom portion of the cylinder sleeve 41 (namely, the lid member 69 supported by the rotor head 38) and the top portion of the piston 42, namely, the volume of the operation chamber 43 when the piston 42 is at the upper dead center on the occasion of assembling the expansion machine E. When the shim 97 interposed between the flange 32*d* of the output shaft 32 and the inner race of the combination angular bearings 23*f* and 23*r* is made thin, the rotor head 38 also moves forward because the output shaft 32 moves forward (the right side in FIG. 1), but the piton 42 cannot move forward by being restricted by the swash plate 31, so that the aforesaid dead volume decreases. On the other hand, when the aforesaid ship 97 is made thick, the rotor head 38 moves rearward (the left side in FIG. 1) with the output shaft 32, and therefore the aforesaid dead volume increases. As a result, it becomes possible to adjust the dead volume optionally only by replacement of the shim 97, and time can be remarkably saved by deleting the process step required for adjustment of the dead volume.

The dead volume can be adjusted only by sandwiching the single shim 97 having a predetermined thickness between the flange 32*d* of the output shaft 32 and the combination angular bearings 23*f* and 23*r*, and fastening the front cover 15 in which the angular bearing 30 for supporting the swash plate 31 and the combination angular bearings 23*f* and 23*r* for supporting the rotor 22 are incorporated, and the rotor 22 in which the pistons 42 . . . are incorporated with the one nut 98. Therefore the adjusting operation can be performed simply as compared with the case in which the thickness of the two front and rear shims are adjusted respectively in the prior art. In addition, on adjustment of the dead volume, the rotor 22 in which the pistons 42 . . . are incorporated may remain to be assembled to the casing body 12, and therefore the confirming operation of the dead volume after the adjustment can be performed while directly watching the contact states of the pistons 42 . . . and the swash plate 31.

When the position of the output shaft 32 is adjusted forward and rearward with respect to the combination angular bearings 23*f* and 23*r* by changing the thickness of the shim 97 as described above, the position of the rotor head 38 at the rear end portion of the rotor 22 also moves forward and rearward, but the rotor head 38 is slidable in the direction of the axis L with respect to the inner race of the radial bearing 24 between it and the casing body 12, and it does not interfere with the adjustment of the position of the output shaft 32.

When the piston 42 is biased in the direction in which it is pushed out of the cylinder sleeve 41 with the pressure of the high-temperature and high-pressure steam supplied to the expansion chamber 43, the pressing force of the piston 42 pushes the outer race of the combination angular bearings 23*f* and 23*r* forward (the right side in FIG. 1) via the swash plate 31, the angular bearing 30, the swash plate holder 28 and the front cover 15, and the pressing force of the cylinder sleeve 41 in the opposite direction of the pressing force of the aforesaid piston 42 pushes the inner race of the combination angular bearings 23*f* and 23*r* rearward (the left side in FIG. 1) via the rotor head 38 and the output shaft 32. Namely, the load generated by the high-temperature and high-pressure steam supplied to the expansion chamber 43 is cancelled out inside the combination angular bearings 23*f* and 23*r*, and is not transmitted to the casing body 12.

While the rotor 22 constructed by the output shaft 32, the three sleeve supporting flanges 33, 34 and 35, the rotor head 38 and the heat insulating cover 40 is made of an iron base material with a comparatively small thermal expansion amount, the casing 11 for supporting the rotor 22 via the combination angular bearings 23*f* and 23*r* and the radial bearing 24 is made of an aluminum base material with a comparatively large thermal expansion amount. Therefore, the difference in the thermal expansion amount especially in the direction along the axis L occurs at the time of low temperature and high temperature of the expansion machine E.

The casing 11 with the larger thermal expansion amount than that of the rotor 22 expands more than the rotor 22 at the time of high temperature and relatively increases in the size in the direction of the axis L, and on the other hands, at the time of low temperature, it contracts more and relatively decreases in the size in the direction of the axis L. Since the casing 11 and the rotor 22 are positioned in the direction of the axis L via the combination angular bearing 23*f* and 23*r*, the difference in the thermal expansion amount between them is absorbed by sliding of the rotor head 38 with respect to the inner race of the radial bearing 24, and an excessive load in the direction of the axis L is prevented from acting on the combination angular bearings 23*f* and 23*r*, the radial bearing 24 and the rotor 22. This not only enhances the durability of the combination angular bearings 23*f* and 23*r* and the radial bearing 24, but also stabilize the support of the rotor 22 to enable it to rotate smoothly, and can prevent the variation in the dead volume between the top portion of the cylinder sleeve 41 and the top portion of the piston 42 following the change in temperature.

The reason is that if opposite end portions of the rotor 22 are restrained at the casing 11 to be unmovable in the axial direction, the casing 11 contracts in the direction of the axis L with respect to the rotor 22 at the time of low temperature, and therefore the piston 42 of which head portion abuts to the swash plate 31 supported at the swash plate holder 28 being a part of the casing 11 is pressed rearward, while the rotor head 38 supported at the casing 11 via the radial bearing 24 is pressed forward, whereby the piston 42 is pressed into the inside of the cylinder sleeve 41 and the dead volume is decreased. On the other hand, at the time of high temperature, the casing 11 expands in the direction of the axis L with respect to the rotor 22, and therefore the piston 42 is pulled out of the inside of the cylinder sleeve 41 to increase the dead volume, whereby increase in the initial volume of the high-temperature and high-pressure steam in the normal operation state after completion of warming up, namely, reduction in the thermal efficiency due to reduction in the volume ratio (expansion ratio) of the expansion machine E occurs.

On the other hand, in this embodiment, the rotor 22 is supported in the floating state in the direction of the axis L with respect to the casing 11, and therefore increase in the clearance between the bearings of the combination angular bearings 23*f* and 23*r* and the radial bearing 24 and reduction in the preload are prevented, thus preventing the variation in the dead volume following the change in temperature. As a result, the stable performance can be secured by preventing the variation in the volume ratio (expansion ratio) of the expansion machine E.

Especially in the expansion machine E using the high-temperature and high-pressure steam as the working medium, the difference between the high temperature and the low temperature becomes large, and therefore the above-described effect can be exhibited effectively. The difference between the high temperature and the low temperature becomes large in the vicinity of the rotary valve 71 to which the high-temperature and high-pressure steam is supplied, but the rotary head 38 is slidable in the direction of the axis L with respect to the radial bearing 24 disposed at the side near the rotary valve 71, and therefore this can absorb the difference of the thermal expansion amount of the casing 11 and the rotor 22 without hindrance.

Next, a second embodiment of the present invention will be explained based on FIG. 16 to FIG. 19.

In the first embodiment, the steam discharge pipe 89 is disposed on the axis L of the rotor 22, and the steam supply pipe 85 is disposed to be eccentric to the outside in the radial direction, but in the second embodiment, the positional relationship is changed, and the steam supplying pipe 85 is disposed on the axis L of the rotor 22, while the steam discharge pipe 89 is disposed at the outer side in the radial direction.

The valve body portion 72 of the first embodiment is formed integrally with the rear cover 18, but the valve body portion 72 of the second embodiment is mounted to the rear cover 18 to be attachable and detachable. Namely, a circular flange 72*a* integrally formed at a rear portion of the valve body portion 72 abuts to the rear surface of the rear cover 18 via a seal member 101, and fixed thereto with a plurality of bolts 102. In this situation, a support portion 72*b* circular in section formed integrally at the front portion of the valve body portion 72 is fitted into a support hole 18*a* of the rear cover 18. The annular holder 79 is fixed to a support surface 18*b* connecting to the support hole 18*a* of the rear cover 18 with a plurality of bolts 80., and the fixed side valve plate 73 held inside this holder 79 via the seal member 82 functioning mainly as an elastic body following the oscillation of the fixed side valve plate 73 is prevented from rotating by the knock pins 81 and 81 coated with Teflon. The fixed side valve plate 73 is positioned in the rotating direction by the knock pins 81 and 81, but is supported to float to be slightly movable in the radial direction and the direction of the axis L.

The pressure chamber 84 circular in section is opened to the mating surface 83 at which the valve body portion 72 abuts to the fixed side valve plate 73. The steam supplying pipe 85 penetrating through the valve body portion 72 via a seal member 103 extends to the mating surface 83 through the center of the pressure chamber 84, and inside the pressure chamber 84, the coil spring 86, the packing retainer 87 and the V-packing 88 are sequentially disposed on the outer periphery of the steam supplying pipe 85.

A small clearance is set between a tip end of the steam supplying pipe 85 and the mating surface 83 of the fixed side valve plate 73, so that even when the steam supplying pipe 85 thermally expands in the direction of the axis L, a tip end thereof does not interfere with the mating surface 83. A through hole 85*a* formed in the steam supplying pipe 85 communicates with the rear portion of the pressure chamber 84. The number of through holes 85*a* may be more than one in accordance with the strength of the steam supplying pipe 85 and necessary steam supply to the pressure chamber 84.

The metal packing retainer 87 includes a cylindrical portion 87*d* loosely fitted on the outer periphery of the steam supplying pipe 85, a conical surface 87*e* to which the coil spring 86 with a constant diameter without tapering abuts, and a conical surface 87*f* for supporting the V-packing 88 at the opposite side of the conical surface 87*e*. The V-packing 88 made of a synthetic resin includes a through-hole 88*d* loosely fitted on the outer periphery of the steam supplying pipe 85, a conical surface 88*e* supported on the conical surface 87*f* of the packing retainer 87, and a flat surface 88*f* abutting to the mating surface 83 of the fixed side valve plate 73.

The first steam passage P1 formed inside the steam supplying pipe 85 communicates with the slide surface 77 via the second steam passage P2 formed in the fixed side valve plate 73. A pressure groove 73*a* formed in the fixed side valve plate 73 and opened to the mating surface 83 communicates with the second steam passage P2 formed in the fixed side valve plate 73 via the communication hole 77*b*.

A steam discharge chamber 104 is formed between the casing body 12 and the rear cover 18, and this steam discharge chamber 104 communicates with the steam discharge pipe 89, and also communicates with the slide surface 77 via the seventh steam passage P7 formed inside the valve body portion 72, and the fifth and sixth steam passages P5 and P6 formed in the fixed side valve plate 73. The fifth steam passage P5 is formed into an arc shape and opened to the slide surface 77, and the sixth and the seventh steam passages P6 and P7 communicating with the fifth steam passage P5 are respectively divided into two and opened to the mating surface 83.

According to the second embodiment, the high-temperature and high-pressure steam supplied from the through hole 85*a* of the steam supplying pipe 85 to the pressure chamber 84 deforms the first seal lip S1 of the V-packing 88 elastically forward in the direction of the axis L, and presses it against the mating surface 83 of the fixed side valve plate 73, and deforms the second seal lip S2 of the V-packing 88 elastically inward in the radial direction, and presses it to the outer periphery surface of the steam supplying pipe 85, thereby exhibiting the sealing performance. The steam supplying pipe 85 in which the high-temperature and high-pressure steam flows thermally expands to a large extent, but due to its comparatively small diameter, the periphery length of the seal surface with the second seal lip S2 becomes short, and therefore the frictional force occurring between the steam supplying pipe 85 and the second seal lip S2 can be reduced.

Since the pressure chamber 84 is formed to enclose the periphery of the steam supplying pipe 85 with the smaller diameter as compared with the steam discharge pipe 89 in the second embodiment, the area A2 in which the pressure of the pressure chamber 84 acts on the mating surface 83 is easily made small. Accordingly, the pressing load for pressing the fixed side valve plate 73 can be made small by setting the ratio A2/A1 to be small, and the effect of restraining the excessive contact pressure from occurring to the slide surface 77 is provided. When excessive contact pressure occurs to the slide surface 77 in spite of the above, the pressure of the slide surface 77 is released to the pressure groove 73*a* opened to the mating surface 83 from a communicating hole 73*b* penetrating through the fixed side valve plate 73, whereby the contact pressure of the slide surface 77 is reduced and the sliding resistance can be decreased.

Since the knock pins 81 and 81 for stopping rotation are disposed at the outer side in the radial direction of the fixed side valve plate 73 in the second embodiment as compared with the first embodiment, the moving amount in the radial direction of the fixed side valve plate 73 is small while the moving amount in the direction of the axis L is large, resulting in that oscillation range of the fixed side valve plate 73 becomes small. Therefore, the second embodiment is excellent especially in the following performance to the vibration at high frequency in the state in which the pressure of steam is high. The mating surface 83 is not directly exposed to the introduced steam in the second embodiment unlike the first embodiment, and therefore the second embodiment is especially suitable for the case in which the temperature of the steam is high.

The other operational effects of the second embodiment are the same as the operational effects in the aforementioned first embodiment.

Figure 20:
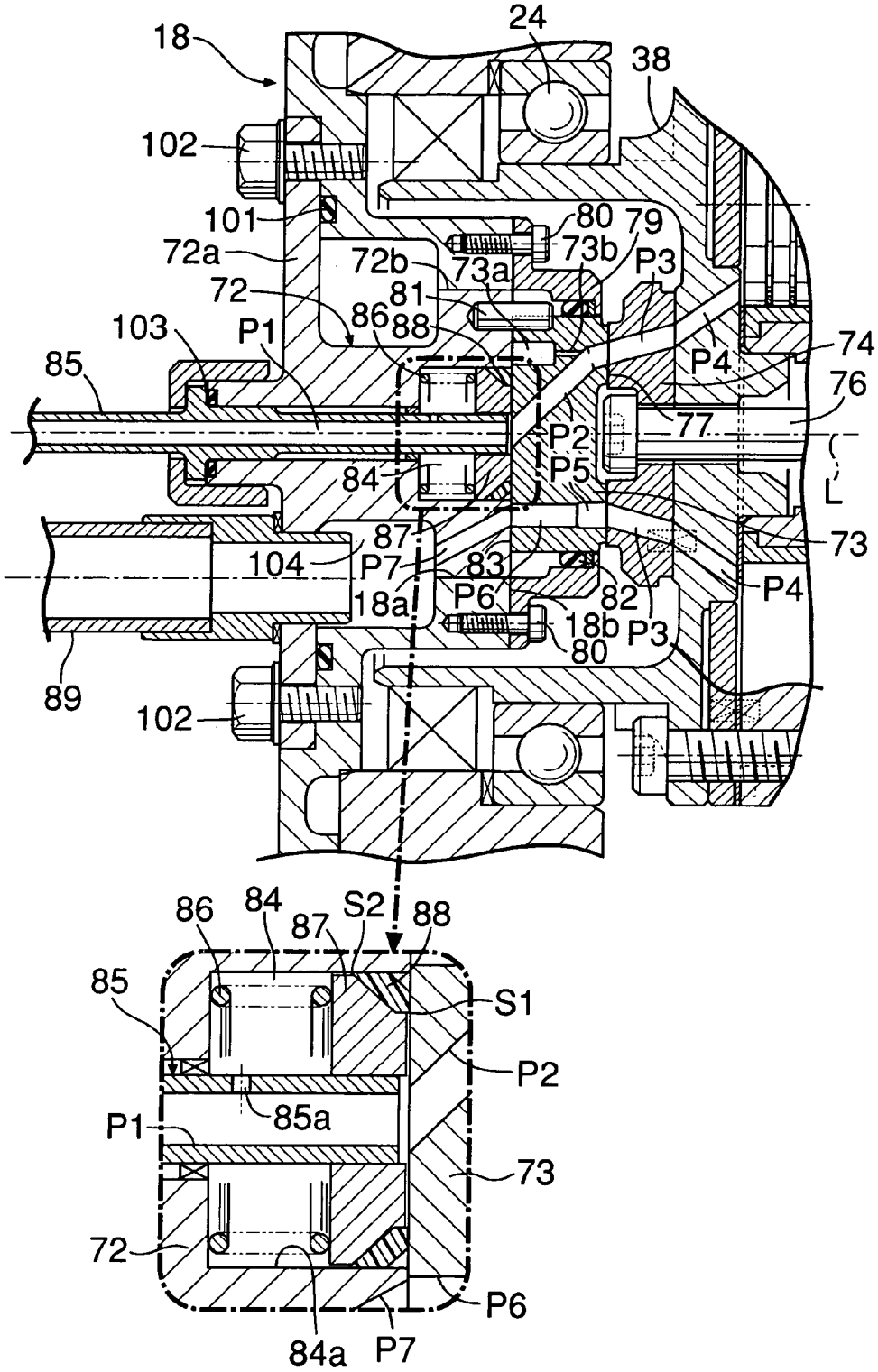
FIG. 20 and FIG. 21 show a third embodiment of the present invention.
Figure 21:
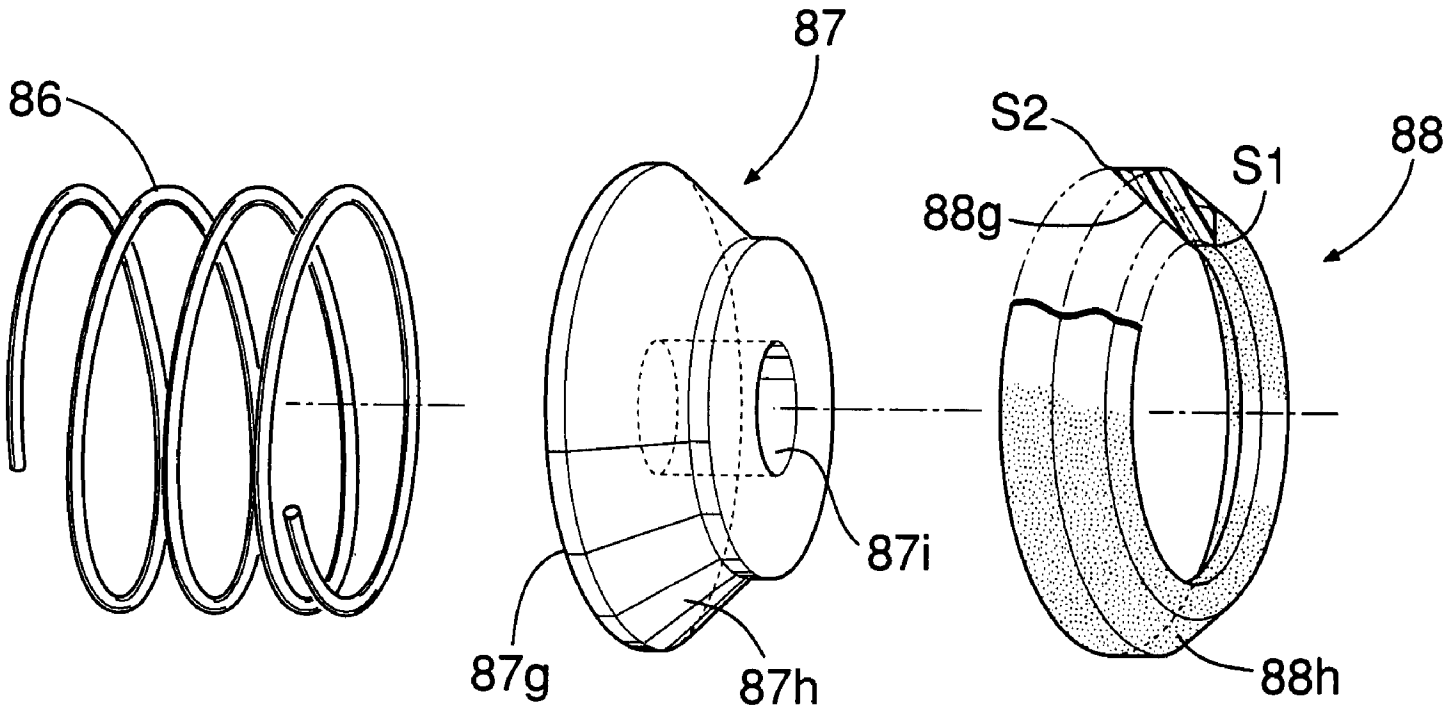

Next, a third embodiment of the present invention will be explained based on FIG. 20 and FIG. 21.

The third embodiment differs from the above-described second embodiment only in the structure of the inside of the pressure chamber 84, and therefore the different point will be mainly explained. In the second embodiment shown in FIG. 16, the first seal lip S1 of the V-packing 88 seals a space from the mating surface 83 of the fixed side valve plate 73, and the second seal lip S2 seals a space from the outer periphery surface of the steam supplying pipe 85. However, in the third embodiment, the first seal lip S1 of the V-packing 88 seals a space from the mating surface 83 of the fixed side valve plate 73, and the second seal lip S2 seals a space from an inner periphery surface 84*a* of the pressure chamber 84.

Namely, the packing retainer 87 which is biased by the coil spring 86 with the constant diameter without tapering includes a flat surface 87*g* to which the coil spring 86 abuts, a conical surface 87*h* formed on the opposite side of the flat surface 87*g*, and a through hole 87*i* loosely fitted on the outer periphery of the steam supplying pipe 85. The V-packing 88 held by the packing retainer 87 includes a conical surface 88*g* supported by the conical surface 87*h* of the packing retainer 87, and a conical surface 88*h* formed on the opposite side of the conical surface 88*g*. A first seal lip S1 for sealing the space from the mating surface 83 of the fixed side valve plate 73 and the second seal lip S2 for sealing the space from the inner periphery surface 84*a* of the pressure chamber 84 are formed at the V-packing 88.

Since this V-packing 88 has its main object to seal the space from the inner periphery surface 84*a* of the pressure chamber 84, the second seal lip S2, which is formed by making the tip end of the conical surface 88*h* thin, is deformed outward in the radial direction with the steam pressure of the pressure chamber 84 to be in close contact with the inner periphery surface 84*a* . Accordingly, the second seal lip S2 favorably follows the extension of the inner diameter of the inner periphery surface 84*a* of the pressure chamber 84 by the thermal extension of the valve body portion 72 to be able to secure sealing performance.

The other operational effects of the third embodiment are the same as the operational effects of the aforementioned second embodiment.

Figure 22:
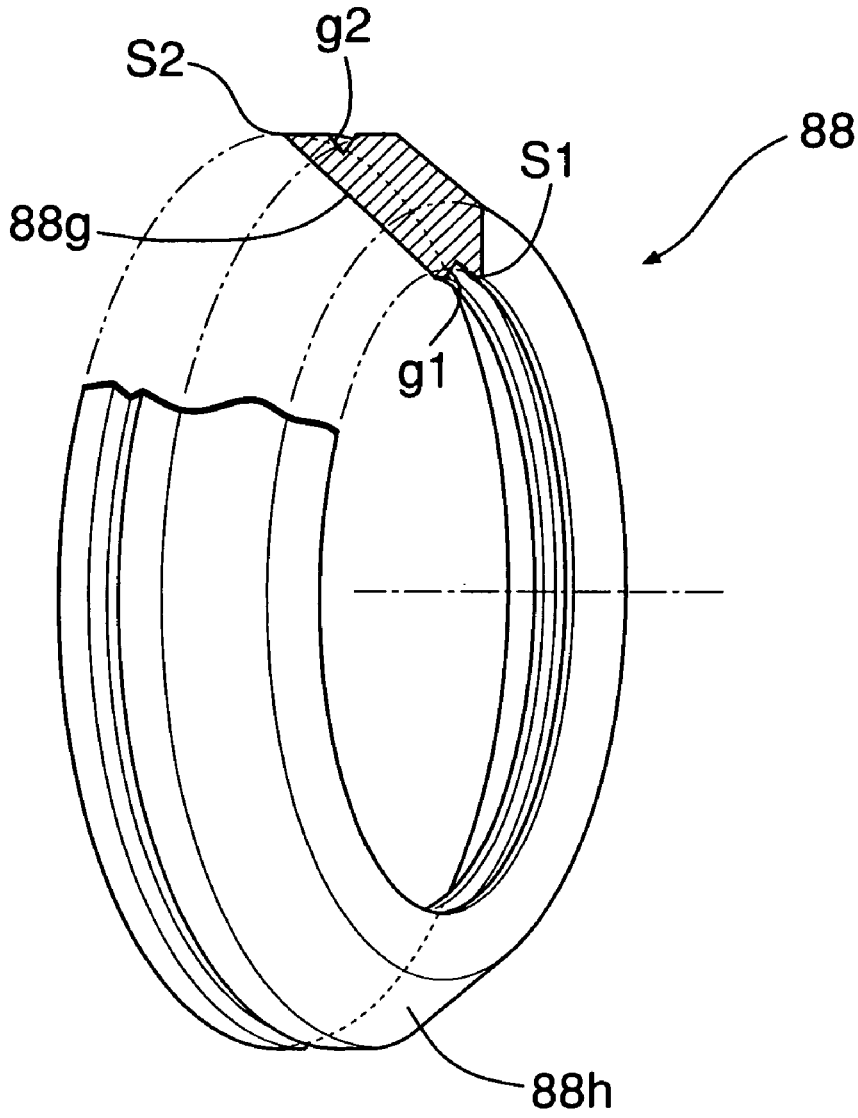
FIG. 22 is a view showing another embodiment of a V-packing according to a fourth embodiment of the present invention.

FIG. 22 shows a fourth embodiment of the present invention, and the V-packing 88 in this fourth embodiment is not made of a synthetic resin, but made of metal or ceramics. In this case, in order to make the seal lips S1 and S2 bend easily, annular grooves g1 and g2 are formed in the vicinity of the seal lips S1 and S2.

Next, a fifth embodiment of the present invention will be explained based on FIG. 23 to FIG. 28.

Figure 23:
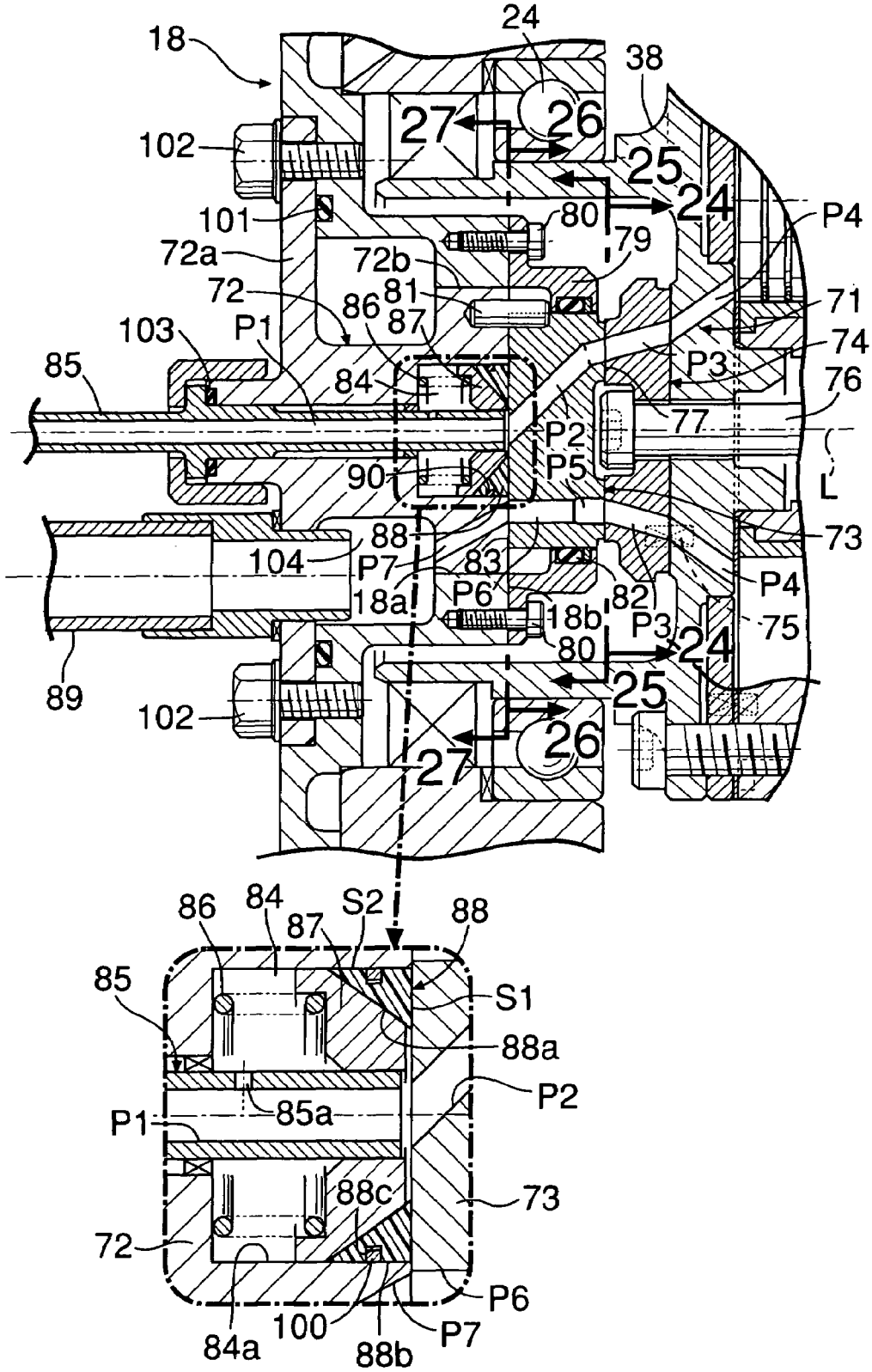
FIG. 23 to FIG. 28 show a fifth embodiment of the present invention.
Figure 24:
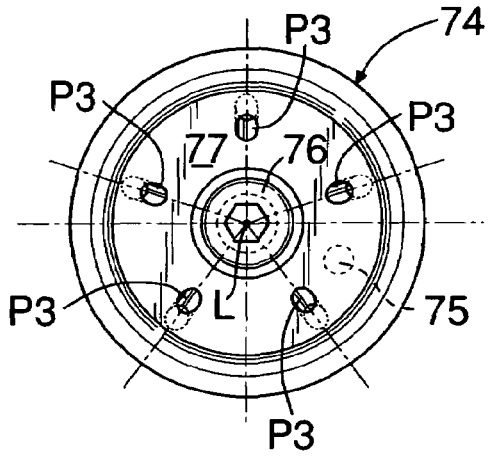
Figure 28:
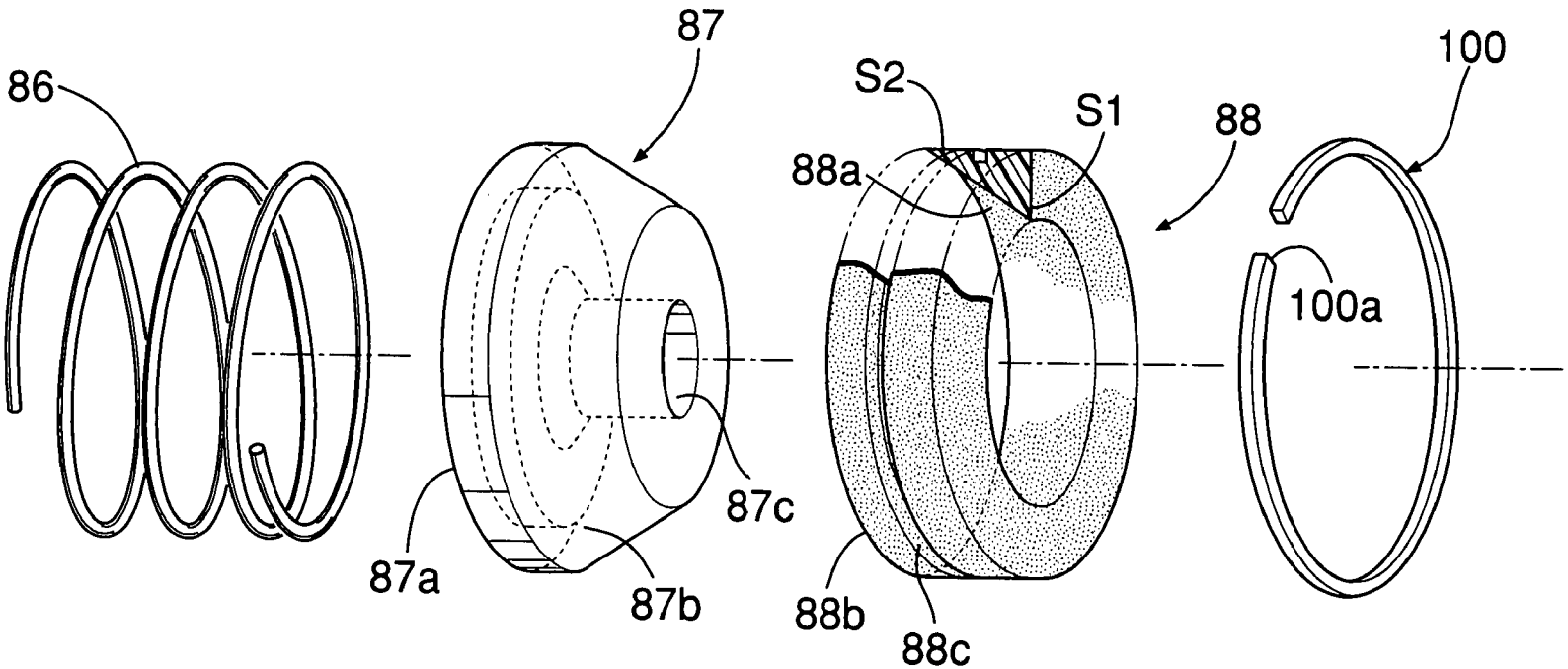

As is apparent from FIG. 23 and FIG. 28, the packing retainer 87 biased by the coil spring 86 with the constant diameter without tapering includes a flat surface 87*a* to which the coil spring 86 abuts, a conical surface 87*b* formed on the opposite side of the flat surface 87*a*, and a through hole 87*c* loosely fitted on the outer periphery of the steam supplying pipe 85. A conical surface 88*a* supported at the conical surface 87*b* of the packing retainer 87, the first seal lip S1 for sealing a space from the mating surface 83 of the fixed side valve plate 73, and the second seal lip S2 for sealing a space from the inner periphery surface 84*a* of the pressure chamber 84 are formed on the V-packing 88 held by the packing retainer 87. A ring groove 88*c* is formed on an outer periphery surface 88*b* of the V-packing 88, and a seal ring 100 fitted in this ring groove 88*c* abuts to the inner periphery surface 84*a* of the pressure chamber 84.

The seal ring 100 is an annular member having a joint 100*a* as the piston ring fitted to the piston of the engine to seal a space from the cylinder, and is pressed against the inner periphery surface of the pressure chamber 84 by its own resilient force to expand in diameter and the pressure of the high-temperature and high-pressure steam acting on the pressure chamber 84 to exhibit sealing performance. This seal ring 100 is a static seal unlike the piston ring, and therefore it is not necessary to perform tapering work and spherical work for its slide surface in the radial direction. The material of the seal ring 100 has resistance to an oxidized scale, and is constituted of a composite material of metal and carbon in this embodiment. DLC (diamond-like carbon: rigid amorphous coating), PVD (physical vapor deposition: physical vapor deposition process) coating using Tin, CrN or the like, or CVD (chemical vapor deposition: chemical vapor deposition process) are applied to the surface of the seal ring 100.

This V-packing 88 has its main object to seal the space from the inner periphery surface 84*a* of the pressure chamber 84, and therefore the second seal lip S2 is deformed outward in the radial direction with the steam pressure of the pressure chamber 84 to be in close contact with the inner periphery surface 84*a*. Accordingly, the second seal lip S2 favorably follows the expansion of the inner diameter of the inner periphery surface 84*a* of the pressure chamber 84 by thermal expansion of the valve body portion 72 to be able to secure sealing performance.

The coil spring 86 has the functions of giving a preload to press the V-packing 88 against the mating surface 83 with the fixed side valve plate 73 before the pressure of the high-temperature and high-pressure steam rises, and of damping the vibration of the fixed side valve plate 73 by the cooperation of the seal member 82 and the pressure of the high-temperature and high-pressure steam in the pressure chamber 84. The packing retainer 87 has the functions of holding the V-packing 88 in a right position inside the pressure chamber 84, and of enhancing the durability of the V-packing 88 by shutting off the heat of the high-temperature and high-pressure steam.

The coil spring 86 has the structure in which the spring seat is abolished to take a large number of windings of spring in a small space of the pressure chamber 84, and is not made to abut to the V-packing 88 directly, but the packing retainer 87 interposed between the coil spring 86 and the V-packing 88 is utilized as the spring seat, whereby it is made unnecessary to provide a special spring seat at the V-packing 88, and the dimension of the pressure chamber 84 in the direction of the axis L can be made compact while the length of the coil spring 86 is secured to the maximum.

As is apparent from FIG. 23 to FIG. 27, the steam supplying pipe 85 is disposed on the axis L of the rotor 22, and the steam discharge pipe 89 is disposed eccentrically to the outside in the diameter direction. The first steam passage P1 formed inside the steam supplying pipe 85 communicates with the slide surface 77 via the second steam passage P2 formed in the fixed side valve plate 73. Five third steam passages P3 . . . disposed equidistantly to surround the axis L penetrate through the movable side valve plate 74, and opposite ends of five of the fourth steam passages P4 . . . formed in the rotor 22 to surround the axis L communicate with the aforesaid third steam passages P3 . . . , and the aforesaid expansion chambers 43 . . . , respectively. While the portion at which the second steam passage P2 is opened to the slide surface 77 is circular, the portion at which the fifth steam passage P5 is opened to the slide surface 77 is formed into an arc shape with the axis L as the center.

The arc-shaped fifth steam passage P5 and two arc-shaped steam passages P6 and P6 are concavely provided on the slide surface 77 of the fixed side valve plate 73, and the sixth steam passages P6 and P6 communicate with two seventh steam passages P7 and P7, which are formed in the valve body portion 72, on the mating surface 83. The steam discharge chamber 104 is formed between the casing body 12 and the rear cover 18, and this steam discharge chamber 104 communicates with the steam discharge pipe 89 and communicates with the two seventh steam passages P7 and P7 formed in the valve body portion 72.

Figure 25:
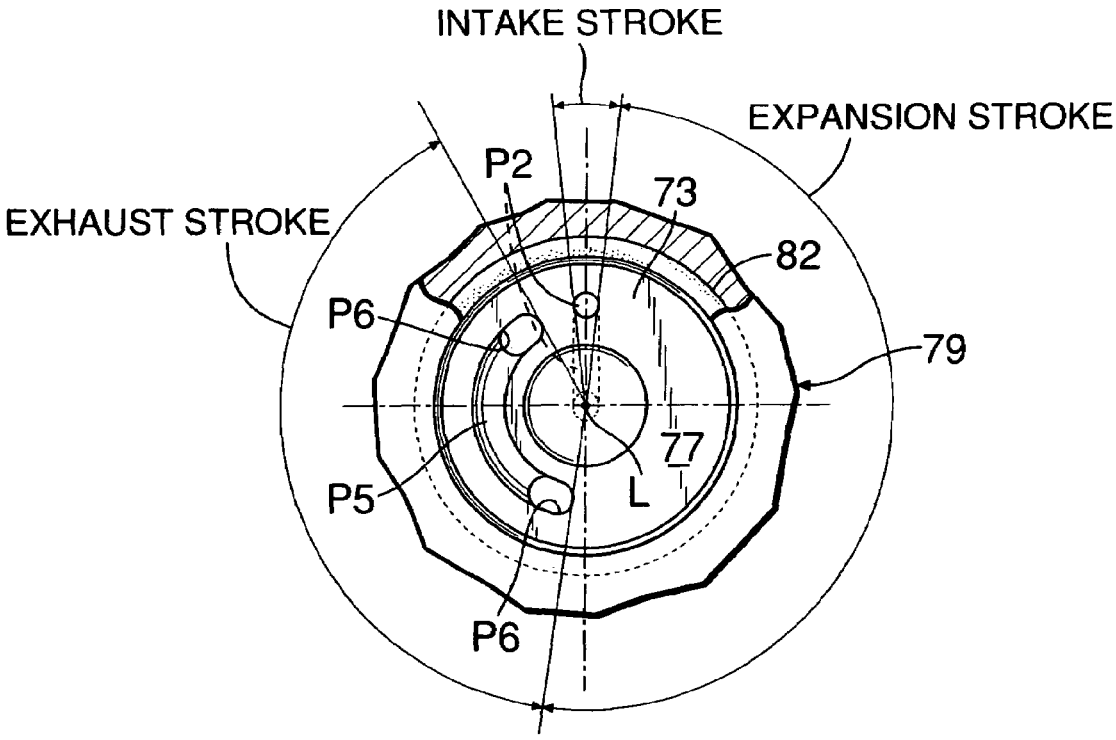
Figure 26:
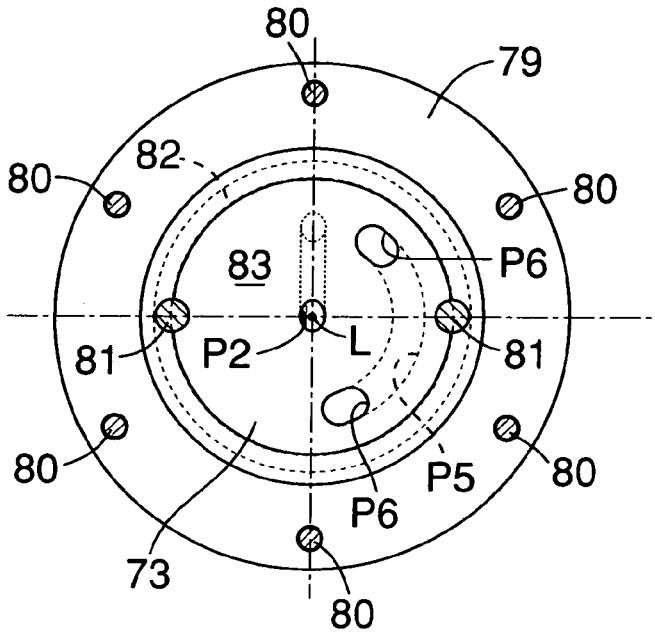
Figure 27:
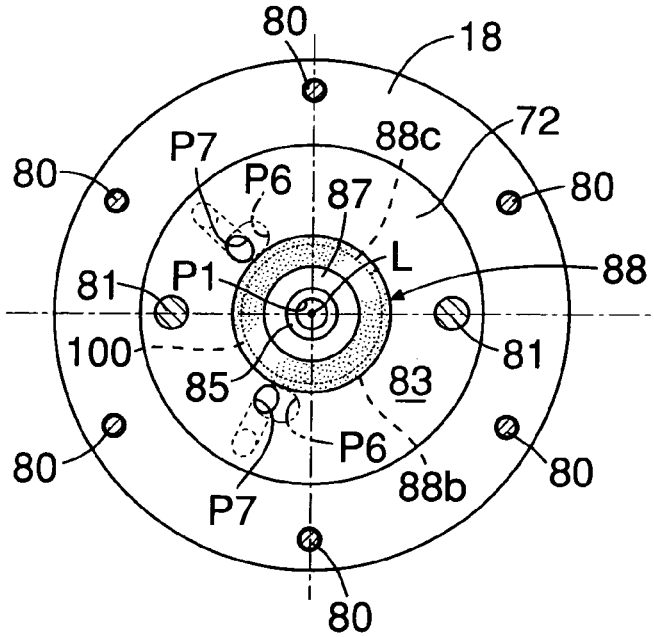

As is apparent from FIG. 25, the circular second steam passage P2 for supplying the high-temperature and high-pressure steam, and the arc-shaped fifth steam passage P5 for discharging the low-temperature and low pressure steam are opened to the slide surface 77 of the fixed side valve plate 73 of the rotary valve 71. The instant at which one of the five third steam passages P3 . . . of the movable side valve plate 74 communicates with the circular second steam passage P2 is the intake stroke, and the period from the time when the communication of the aforesaid third steam passage P3 and the second steam passage P2 are shut off until the third steam passage P3 communicates with the arc-shaped fifth steam passage P5 is the expansion stroke, and the period during which the aforesaid third steam passage P3 communicates with the arc-shaped fifth steam passage P5 is the discharge stroke.

Incidentally, it is inevitable that an oxidized scale gets into the high-temperature and high-pressure steam generated in the evaporator, and when the high-temperature and high-pressure steam including the oxidized scale is supplied to the pressure chamber 84 from the steam supplying pipe 85 via the through hole 85*a*, there is the possibility that the oxidized scale enters a space between the outer periphery surface 88*b* of the V-packing 88 and the inner periphery surface 84*a* of the pressure chamber 84, and seriously damages the outer periphery surface 88*b* of the V-packing 88 in the direction of the axis L. If the outer periphery surface 88*b* of the V-packing 88 is thus damaged, the sealing performance is impaired, and the high-temperature and high-pressure steam leaks to the mating surface 83, which reduces the contact pressure of the slide surface 77 of the fixed side valve plate 73 and the movable side valve plate 74, to deteriorate the performance of the expansion machine E. Since the high-temperature and high-pressure steam which should originally remain inside the pressure chamber 84 flows away by the aforesaid leakage, there arises the fears that the inside of the pressure chamber 84 is exposed to high temperature and oxidized by the newly supplied high-temperature and high-pressure steam, and the V-packing 88 housed in the pressure chamber 84 is thermally deformed due to high temperature and reduces in its sealing performance.

However, according to this embodiment, the oxidized scale is caught by the effect of the seal ring 100 fitted in the ring groove 88*c* of the outer periphery surface 88*b* of the V-packing 88, and a damage to the outer periphery surface 88*b* of the V-packing 88 by the oxidized scale can be prevented. Namely, since the seal ring 100 is constituted of the composite material of soft carbon and rigid metal, the oxidized scale is stuck into the carbon and caught, so that the sealing performance is secured by the hard metal. Especially at the time of low temperature immediately after the start of the expansion machine E, the V-packing 88 cannot exhibit an effective sealing function due to low pressure of the steam, but in such a case, the seal ring 100 can exhibit an effective sealing function and prevent leakage of the steam, and thereafter, when the pressure of the steam sufficiently rises, the V-packing 88 can exhibit the original sealing function.

Figure 29:
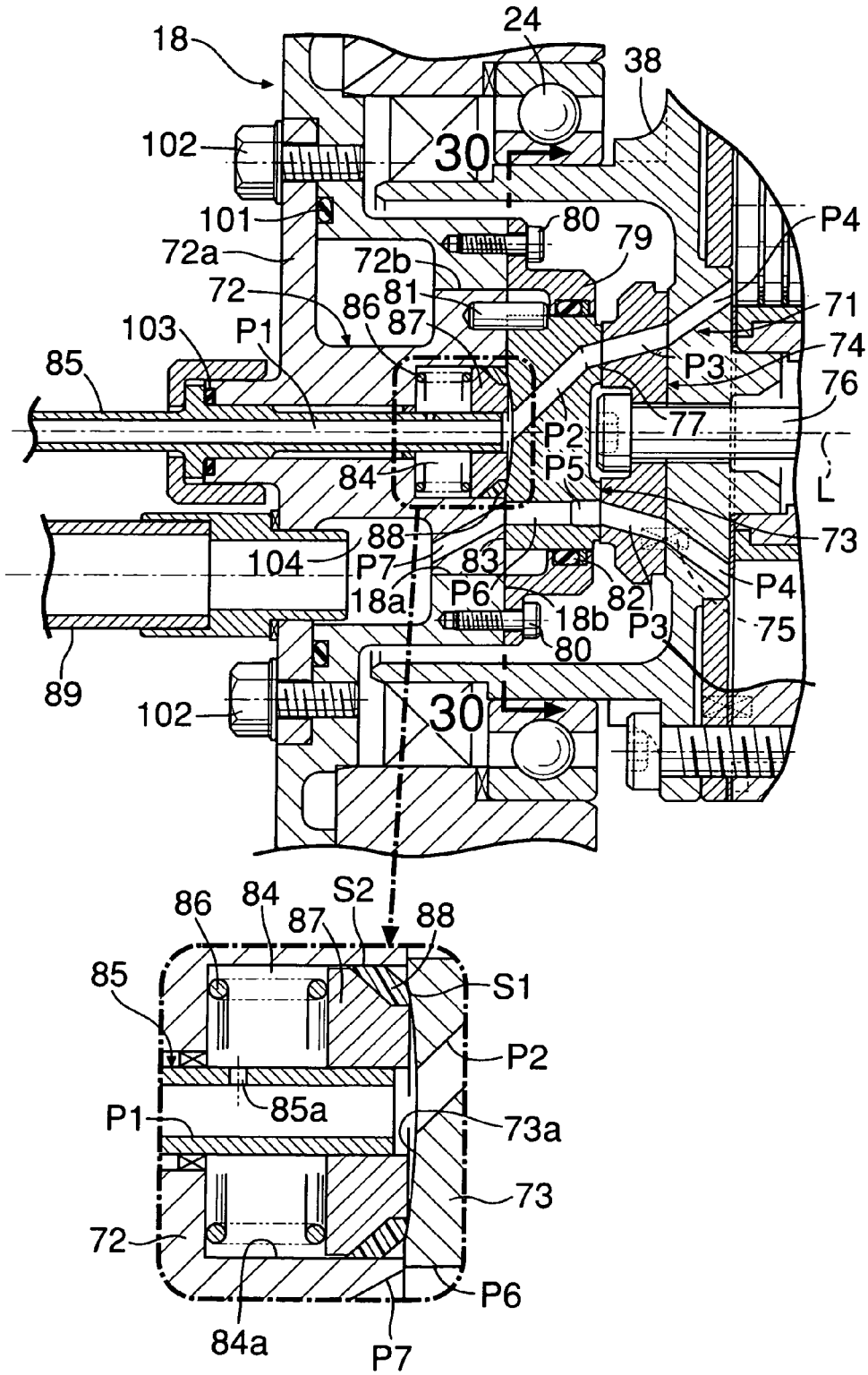
FIG. 29 to FIG. 31 show a sixth embodiment of the present invention.
Figure 30:
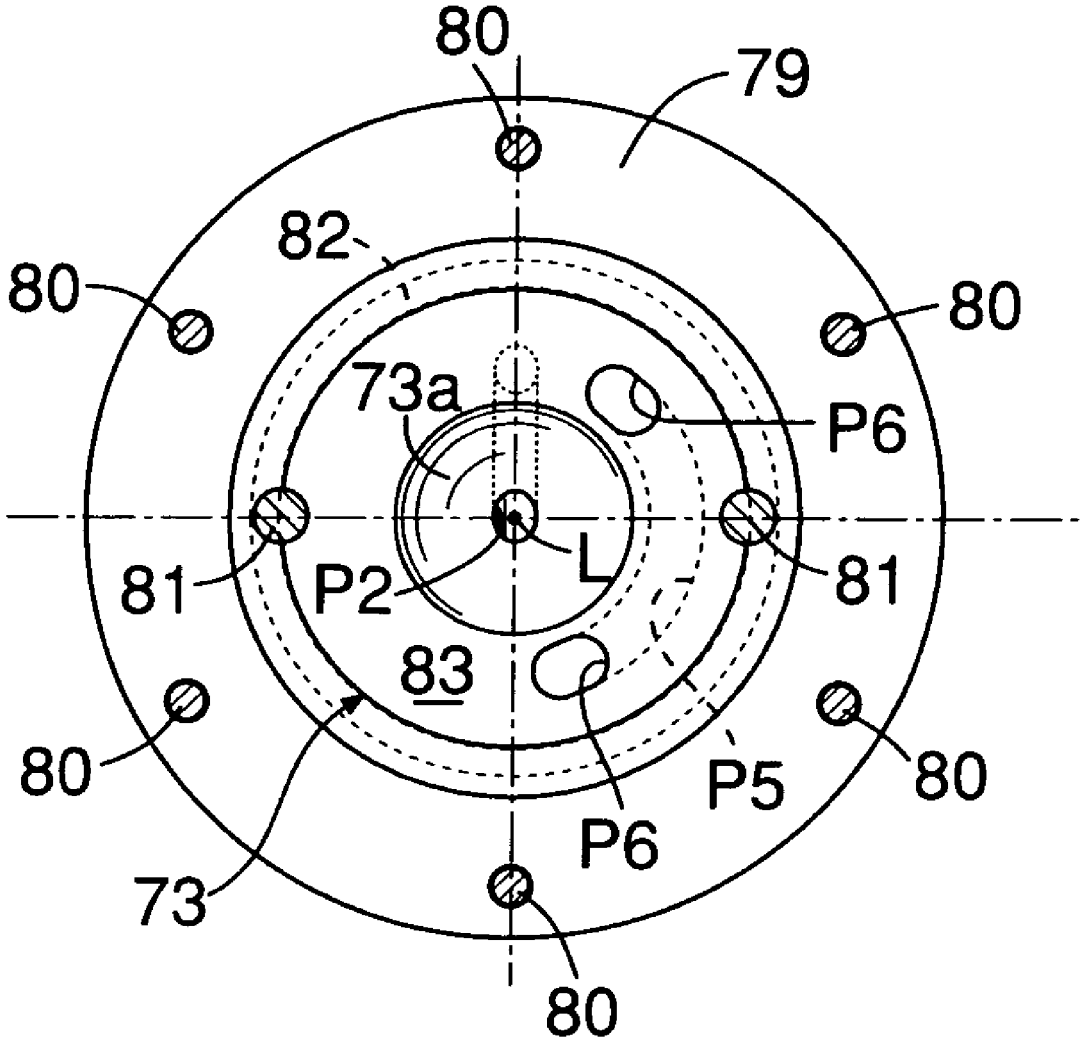
Figure 31:
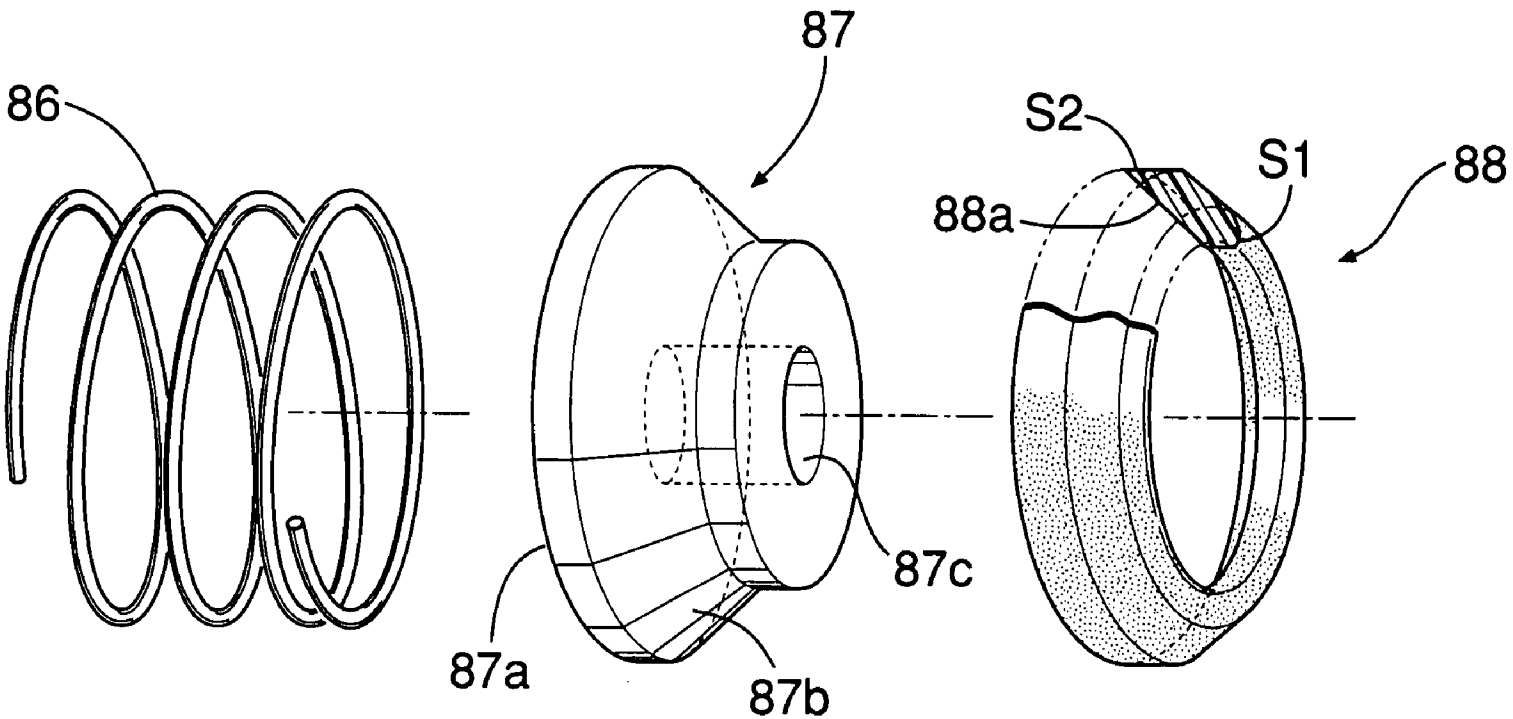

Next, a sixth embodiment of the present invention will be explained based on FIG. 29 to FIG. 31.

The packing retainer 87 biased by the coil spring 86 with the constant diameter without tapering includes the flat surface 87*a* to which the coil spring 86 abuts, the conical surface 87*b* formed on the opposite side of the flat surface 87*a*, and the through hole 87*c* loosely fitted on the outer periphery of the steam supplying pipe 85. The conical surface 88*a* supported on the conical surface 87*b* of the packing retainer 87, the first seal lip S1 for sealing a space from the mating surface 83 of the fixed side valve plate 73, and the second seal lip S2 for sealing a space from the inner periphery surface 84*a* of the pressure chamber 84 are formed on the V-packing 88 held by the packing retainer 87. This V-packing 88 has its main object to seal the space from the inner periphery surface 84*a* of the pressure chamber 84, and the second seal lip S2 is deformed outward in the radial direction with the steam pressure of the pressure chamber 84 to be in close contact with the inner periphery surface 84*a*. Accordingly, the second seal lip S2 favorably follows the expansion of the inner diameter of the inner periphery surface 84*a* of the pressure chamber 84 due to thermal expansion of the valve body portion 72 to be able to secure sealing performance.

A seat surface 73*a* in a center of the mating surface 83 of the fixed side valve plate 73 is recessed in the shape of a spherical surface having a center on the axis L, and the first seal lip S1 of the V-packing 88 which abuts to this seat surface 73*a* protrudes in the shape of a spherical surface having a center on the axis L. The radiuses of curvature and centers of the seat surface 73*a* and the first seal lip S1 correspond to each other. Consequently, the first seal lip S1 is in close contact with the seat surface 73*a* without a clearance and can swing with each other with sealing performance being secured.

It is inevitable that the output shaft 32 of the rotor 22 is inclined with respect to the axis L by a slight positional deviation or the like of the combination angular bearings 23*f* and 23*r* and the radial bearing 24, and when the movable side valve plate 74 supported on the rotor 22 oscillates due to this, the fixed side valve plate 73 supported at the valve body portion 72 to float and abutting to the movable side valve plate 74 via the slide surface 77 also oscillates. On this occasion, there arises the fear that the first seal lip S1 of the V-packing 88 is detached from the seat surface 73*a* of the fixed side valve plate 73 and the sealing performance is lost, because the V-packing 88 housed in the pressure chamber 84 formed in the valve body portion 72 has substantially no degree of freedom for the movement in the inclined direction with respect to the axis L, though it has a comparatively high degree of freedom for the movement in the direction of the axis L.

However, according to this embodiment, the seat surface 73*a* of the fixed side valve plate 73 and the first seal lip S1 of the V-packing 88, which abuts to the seat surface 73*a*, abuts to each other via the common spherical surface, and therefore the fixed side valve plate 73 can oscillate with the seat surface 73*a* and the first seal lip S1 kept in close contact with each other, thus making it possible to restrain leakage of the high-temperature and high-pressure steam while securing the sealing performance at this portion, and prevent reduction in output power of the expansion machine E. Especially because the seat surface 73*a* of the fixed side valve plate 73 is made a concave curved surface, and the first seal lip S1 of the V-packing 88 is made a convex curved surface, the following performance of the V-packing 88 to the oscillation of the fixed side valve plate 73 is further enhanced, and leakage of the high-temperature and high-pressure steam can be restrained more effectively.

Next, a seventh embodiment of the present invention will be explained based on FIG. 32 and FIG. 33.

A backup ring 105 is disposed in the inside of the pressure chamber 84 in addition to the coil spring 86, the packing retainer 87 and the V-packing 88. The packing retainer 87 biased by the coil spring 86 with the constant diameter without tapering includes the flat surface 87*a* to which the coil spring 86 abuts, the conical surface 87*b* formed on the opposite side of the flat surface 87*a*, and the through hole 87*c* loosely fitted on the outer periphery of the steam supplying pipe 85. The backup ring 105 in the shape of a cone with its head being cut, which is made by press-molding a thin stainless plate having elasticity and silver-plating surfaces, has an inner surface 105*a* opposing the conical surface 87*b* of the packing retainer 87, and an outer surface 105*b* opposing the conical surface 88*a* of the V-packing 88 which will be described later. A sectional shape thereof in a free state is curved so as to protrude from the side of the inner surface 105*a* to the side of the outer surface 105*b*.

The conical surface 88*a* opposing the outer surface 105*b* of the backup ring 105, the first seal lip S1 for sealing a space from the mating surface 83 of the fixed side valve plate 73, and the second seal lip S2 for sealing a space from the inner periphery surface 84*a* of the pressure chamber 84 are formed on the V-packing 88 supported by the packing retainer 87 via the backup ring 105.

Incidentally, when the pressure of the steam supplied to the pressure chamber 84 is low, the second seal lip S2 of the V-packing 88 cannot be pressed against the inner periphery surface 84*a* of the pressure chamber 84 firmly with the pressure of the steam, and there is the possibility that the sealing function is reduced to allow the steam to leak out of the pressure chamber 84. Since the coil spring 86 has the function of mainly pressing the V-packing 88 in the direction of the axis L to press the first seal lip S1 of the V-packing 88 against the fixed side valve plate 73, the effect of enhancing the sealing performance of the second seal lip S2 cannot be expected.

However, the backup ring 105 sandwiched between the packing retainer 87 and the V-packing 88 is compressed in the direction of the axis L by the pressure of the pressure chamber 84 and the resilient force of the coil spring 86, and its sectional shape is changed from the curved state to the linear state, whereby a preload to bias the V-packing 88 diagonally forward is generated, and the second seal lip S2 of the V-packing 88 is pressed against the inner periphery surface 84*a* of the pressure chamber 84 with the radially outward component of the preload, thereby exhibiting the sealing function.

When the inside of the pressure chamber 84 is in the high-temperature state, the resilient force of the coil spring 86 reduces, and therefore a load to compress the backup ring 105 in the axial direction decreased. However, the backup ring 105 made of metal thermally expands in the radial direction, and the outer periphery surface of the backup ring 105 abuts to the inner periphery surface 84*a* of the pressure chamber 84 and the backup ring 105 is prevented from moving in the radial direction, whereby the backup ring 105 is thermally deformed in the direction in which the degree of curve increases to increase the load pressing the V-packing 88, and presses the second seal lip S2 to the inner periphery surface 84*a* of the pressure chamber 84 with the radially outward component of the load, thereby enhancing the sealing performance.

When the sealing performance between the second seal lip S2 of the V-packing 88 and the inner periphery surface 84*a* of the pressure chamber 84 easily reduces at the time of high-temperature and low-pressure of the steam such as at the idling time, the second seal lip S2 of the V-packing 88 is firmly pressed against the inner periphery surface 84*a* of the pressure chamber 84 by the action of the backup ring 105, so that leakage of the steam is effectively restrained to thereby prevent reduction in performance of the expansion machine E.

The embodiments of the present invention have been explained above, but it is possible to make various design modifications of the present invention in the range which does not deviate from the subject matter of the present invention.

For example, the expansion machine E includes the axial piston cylinder group 56 as the working part, but the structure of the working part is not limited thereto.

In the first embodiment to the fourth embodiment, the sectional shape of the V-packing 88 is not limited to those in the embodiments, and it is properly changeable. Generally, when the steam pressure acting on the V-packing 88 is high, the sealing effect by bending of the seal lip can be expected, and therefore it is desirable to make the seal lip as thin as possible so that it is easily bent. On the other hand, when the steam pressure acting on the V-packing 88 is low, the sealing effect by bending of the seal lip cannot be expected, and therefore it is desirable to make the seal lip thick to obtain the sealing effect with elasticity of the seal lip itself.

In the fifth embodiment, the material of the seal ring 100 is not limited to the composite material of carbon and metal, but it may be ceramics. Hard ceramics are not only excellent in sealing performance and abrasion resistance, but also excellent in the performance of catching oxidized scales because of its porosity.

The seat surface 73*a* of the fixed side valve plate 73 is recessed while the first seal lip S1 of the seal member 88 is protruded in the sixth embodiment, but the seat surface 73*a* may be protruded and the first seal lip S1 may be recessed by reversing this relationship.

Figure 32:
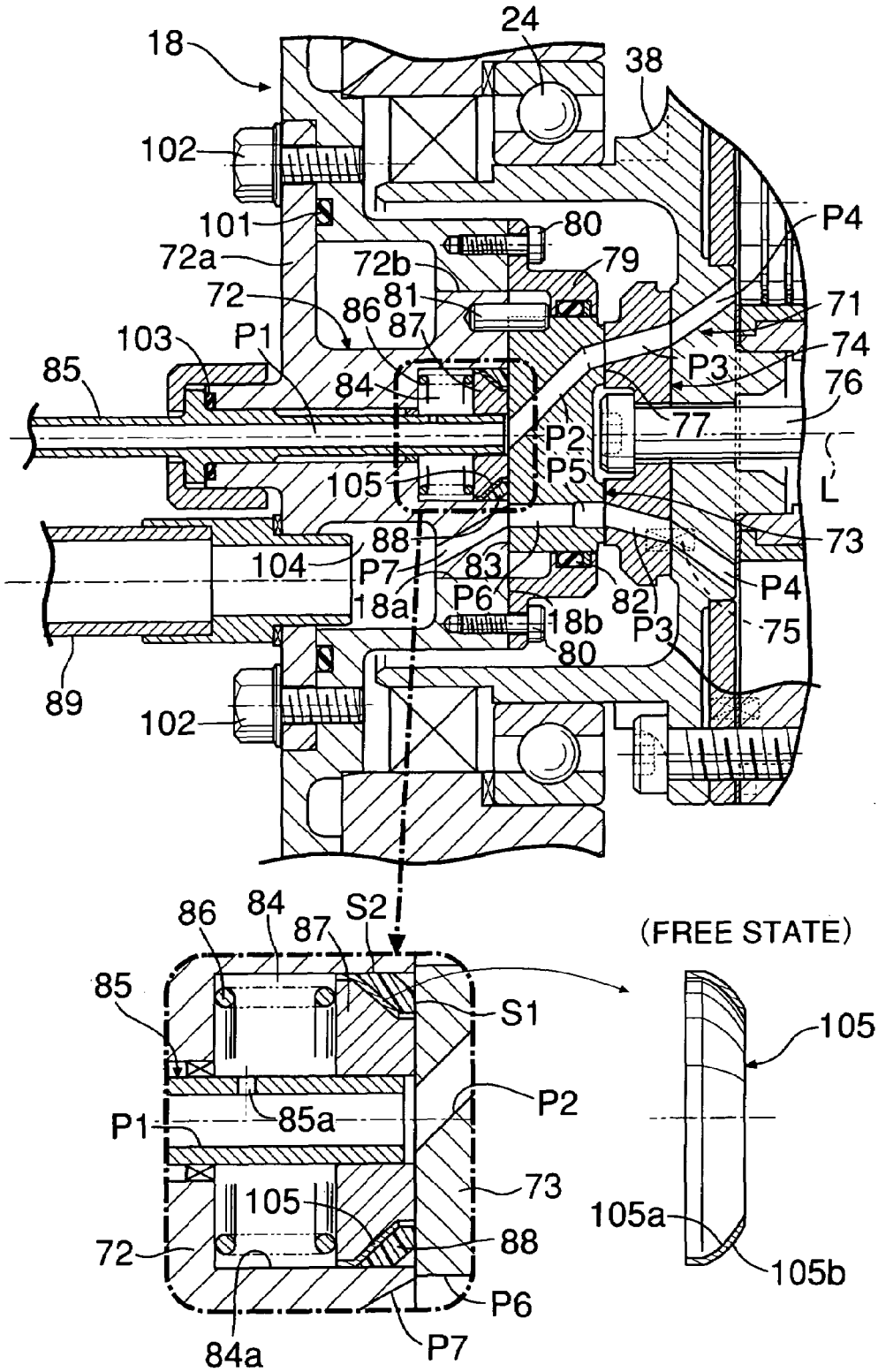
FIG. 32 and FIG. 33 show a seventh embodiment of the present invention.
Figure 33:
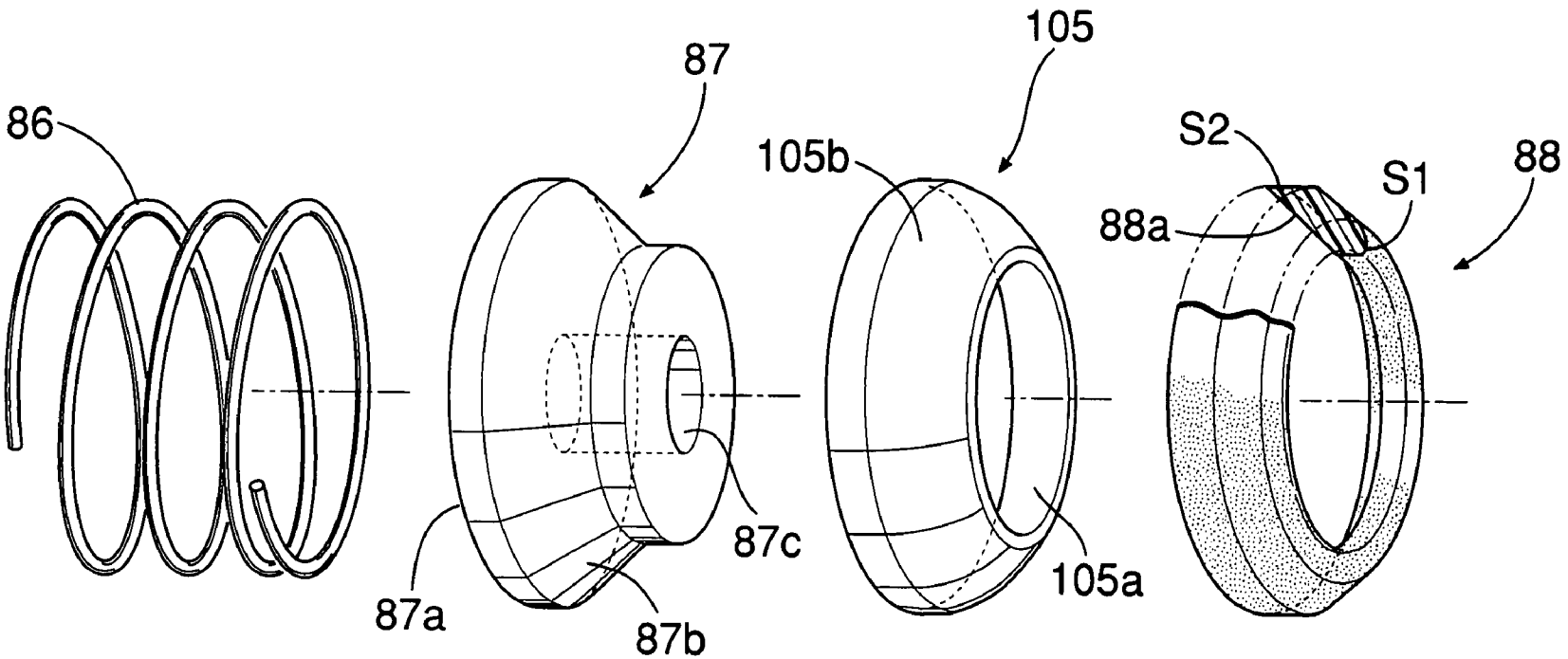

The shape of the backup ring 105 in the seventh embodiment is not limited to the curved shape as shown in FIG. 32 and FIG. 33, but it may have a linear inner surface 105*a* and outer surface 105*b* similar to the conical surface 87*b* of the packing retainer 87 and the conical surface 88*a* of the V-packing 88, in order to obtain convenience in manufacturing and machining. In short, any backup ring may be used as long as it generates a pressing force to press the outer periphery surface (conical surface 88*a*) of the seal member (V-packing 88) against the inner periphery surface 84*a* of the pressure chamber 84 by changing the curvature or the like to exhibit the sealing function.

The rotating fluid machine of the present invention is not limited to the expansion machine E, and it is also applied to a compressor, a liquid-pressure pump, a liquid-pressure motor and the like.

What is claimed is:

1. A rotating fluid machine comprising:

a casing;

a rotor rotatably supported at the casing;

a working part provided at the rotor; and a rotary valve provided between the casing and the rotor and switching a supply passage and a discharge passage of a working medium for the working part, in which the rotary valve comprises a movable side valve plate provided at the rotor, a valve body portion fixed to the casing, and a fixed side valve plate supported at the valve body portion, said movable side valve plate and said fixed side valve plate abut to each other on a slide surface orthogonal to an axis, wherein said fixed side valve plate is floatingly supported on the valve body portion non-rotatably but relatively movably with respect to the valve body portion within an axial limited range, wherein a pressure chamber into which the working medium is introduced from a passage at a high pressure side out of the supply passage and the discharge passage of the working medium is opened to mating surfaces between the valve body portion and the fixed side valve plate, leakage of the working medium from the pressure chamber to the mating surfaces is sealed by a seal member housed in this pressure chamber, and the fixed side valve plate is pressed toward the slide surface with pressure of the working medium acting on the pressure chamber.

2. The rotating fluid machine according to claim 1, wherein the seal member has a seal lip elastically deformable by softening due to pressure and heat of the working medium.

3. The rotating fluid machine according to claim 1 or 2, further comprising resiliently biasing means for biasing the seal member toward the mating surface.

4. The rotating fluid machine according to claim 3, wherein the resiliently biasing means is a taper coil spring tapering toward the seal member.

5. The rotating fluid machine according to claim 1, wherein a passage at a low temperature side out of the supply passage and the discharge passage of the working medium is provided in a center of the valve body portion, and an annular pressure chamber is formed to surround a periphery of the passage at the low temperature side.

6. The rotating fluid machine according to claim 1, wherein the passage at the high pressure side out of the supply passage and the discharge passage of the working medium is provided in a center of the valve body portion, and an annular pressure chamber is formed to surround a periphery of the passage at the high pressure side.

7. The rotating fluid machine according to claim 1, wherein the seal member has a first seal lip for sealing a space from the mating surface of the fixed side valve plate, and a second seal lip for sealing a space from an inner periphery surface of the pressure chamber.

8. The rotating fluid machine according to claim 1, wherein the seal member has a first seal lip for sealing a space from the mating surface of the fixed side valve plate, and a second seal lip for sealing a space from an outer periphery surface of a working medium pipe inserted into the pressure chamber.

9. The rotating fluid machine according to claim 1, wherein contact pressure of the slide surface is set in accordance with a ratio of an area, in which pressure of the pressure chamber acts on the mating surface, to an area of the slide surface.

10. The rotating fluid machine according to claim 1, wherein the seal member has two conical surfaces.

11. The rotating fluid machine according to claim 1, wherein the seal member is V-packing.

12. The rotating fluid machine according to claim 1, wherein the seal member has at least one conical surface.

13. A rotating fluid machine comprising:

a casing;

a rotor rotatably supported at the casing;

a working part provided at the rotor; and a rotary valve provided between the casing and the rotor and controlling supply and discharge of a working medium for the working part, in which the rotary valve comprises a fixed side valve plate, a valve body portion fixed at a casing side, and a movable side valve plate supported at a rotor side, said fixed side valve plate and said movable side valve plate being brought into contact with each other on a slide surface orthogonal to an axis;

wherein said fixed side valve plate is floatingly supported on the valve body portion non-rotatably but relatively movably with respect to the valve body portion within an axial limited range;

a pressure chamber into which the high-pressure working medium is introduced is opened to mating surfaces between the valve body portion and the fixed side valve plate;

leakage of the working medium from the pressure chamber to the mating surfaces is prevented by a seal member housed in the pressure chamber; and the fixed side valve plate and the movable side valve plate are brought into close contact with each other on the slide surface with pressure of the working medium acting on the pressure chamber, wherein a seal ring for receiving the pressure of the working medium is provided on an outer periphery surface of the seal member, and a space between an inner periphery surface of the pressure chamber and the outer periphery surface of the seal member is sealed by the seal ring.

14. The rotating fluid machine according to claim 13, wherein the seal ring is constructed by a material with resistance to oxidized scale.

15. The rotating fluid machine according to claim 14, wherein the material with the resistance to the oxidized scale is a composite material of metal and carbon, or ceramics.

16. The rotating fluid machine according to claim 13, wherein the seal ring fits into a groove formed on the outer periphery surface of the sealing member.

17. The rotating fluid machine according to claim 13, wherein the seal ring includes an open joint.

18. A rotating fluid machine comprising:

a casing;

a rotor rotatably supported at the casing;

a working part provided at the rotor; and a rotary valve provided between the casing and the rotor and controlling supply and discharge of a working medium for the working part, in which the rotary valve comprises a movable side valve plate provided at the rotor, a valve body portion fixed to the casing, and a fixed side valve plate supported at the valve body portion, said movable side valve plate and said fixed side valve plate being brought into contact with each other on a slide surface orthogonal to an axis, wherein said fixed side valve plate is floatingly supported on the valve body portion;

the rotating fluid machine further comprising:

a pressure chamber into which the high-pressure working medium is introduced is opened to a mating surface of the valve body portion with the fixed side valve plate;

wherein leakage of the working medium from the pressure chamber to the mating surface is prevented by a seal member housed in the pressure chamber, the fixed side valve plate and the movable side valve plate are brought into contact with each other on the slide surface with pressure of the working medium acting on the pressure chamber, and wherein a lip of the seal member and a seat surface of the fixed side valve plate to which the seal member abuts are formed into spherical surfaces each having a center on the axis.

19. The rotating fluid machine according to claim 18, wherein the lip of the seal member is formed into a convex shape, and the seat surface of the fixed side valve plate is formed into a concave shape.

20. A rotating fluid machine comprising:

a casing;

a rotor rotatably supported at the casing;

a working part provided at the rotor;

a rotary valve provided between the casing and the rotor and controlling supply and discharge of a working medium for the working part, in which the rotary valve comprises a movable side valve plate provided at the rotor, a valve body portion fixed to the casing, and a fixed side valve plate supported at the valve body portion, said movable side valve plate and said fixed side valve plate being brought into contact with each other on a slide surface orthogonal to an axis, wherein said fixed side valve plate is floatingly supported on the valve body portion;

the rotating fluid machine further comprising:

a pressure chamber into which the high-pressure working medium is introduced is opened to a mating surface of the valve body portion with the fixed side valve plate;

wherein leakage of the working medium from the pressure chamber to the mating surface is prevented by a seal member housed in the pressure chamber, the fixed side valve plate and the movable side valve plate are brought into contact with each other on the slide surface with pressure of the working medium acting on the pressure chamber, and wherein a pressing member for pressing the seal member at least outward in a radial direction is provided at a rear surface of the seal member.

21. The rotating fluid machine according to claim 20, wherein the pressing member presses the seal member with a preload.

22. The rotating fluid machine according to claim 20 or 21, wherein the pressing member is made of metal.

* * * * *